US009458847B2

(12) United States Patent
Ignatiev et al.

(10) Patent No.: US 9,458,847 B2
(45) Date of Patent: Oct. 4, 2016

(54) SCROLL COMPRESSOR HAVING BIASING SYSTEM

(71) Applicant: Emerson Climate Technologies, Inc., Sidney, OH (US)

(72) Inventors: Kirill M. Ignatiev, Sidney, OH (US); James F. Fogt, Sidney, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 20 days.

(21) Appl. No.: 14/319,756

(22) Filed: Jun. 30, 2014

(65) Prior Publication Data

US 2014/0348679 A1 Nov. 27, 2014

Related U.S. Application Data

(63) Continuation of application No. 13/528,285, filed on Jun. 20, 2012, now Pat. No. 8,764,423, which is a continuation of application No. 12/938,848, filed on Nov. 3, 2010, now Pat. No. 8,226,387, which is a (Continued)

(51) Int. Cl.
*F03C 2/00* (2006.01)
*F03C 4/00* (2006.01)

(Continued)

(52) U.S. Cl.
CPC ..... *F04C 18/0215* (2013.01); *F04C 18/0253* (2013.01); *F04C 18/0261* (2013.01); *F04C 23/008* (2013.01); *F04C 27/005* (2013.01);

(Continued)

(58) Field of Classification Search
CPC ..... F04C 18/0215; F04C 18/0246; F04C 18/0253; F04C 18/0261; F04C 23/008; F04C 27/005; F04C 29/0007
USPC ..... 418/55.1–55.6, 57, 270; 417/310
See application file for complete search history.

(56) References Cited

U.S. PATENT DOCUMENTS 2,841,089 A 7/1958 Jones
4,350,479 A 9/1982 Tojo et al.

(Continued)

FOREIGN PATENT DOCUMENTS

CN 1139727 C 12/1996
CN 1139727 A 1/1997

(Continued)

OTHER PUBLICATIONS

Passasge / Definition of Passage by Merriam-Webster—http://www.merriam-webster.com/dictionary/passage—Mar. 20, 2016.*

(Continued)

*Primary Examiner* — Theresa Trieu
(74) *Attorney, Agent, or Firm* — Harness, Dickey & Pierce, P.L.C.

(57) ABSTRACT

A compressor may include non-orbiting scroll, an orbiting scroll, and a bearing housing. The non-orbiting scroll may include a recess. The orbiting scroll may be intermeshed with the non-orbiting scroll to from a plurality of compression pockets therebetween. The orbiting scroll may include first and second apertures. The first aperture may communicate with one of the compression pockets. The second aperture may communicate with the recess. The bearing housing may support the orbiting scroll and cooperate with the orbiting scroll to define a chamber therebetween. The chamber may communicate with the first and second apertures.

20 Claims, 19 Drawing Sheets

Related U.S. Application Data continuation of application No. 12/420,519, filed on Apr. 8, 2009, now Pat. No. 7,837,452, which is a continuation of application No. 11/259,237, filed on Oct. 26, 2005, now abandoned.

(51) Int. Cl.

| | |
|---|---|
| ***F04C 18/00*** | (2006.01) |
| ***F04C 18/02*** | (2006.01) |
| ***F04C 29/00*** | (2006.01) |
| ***F04C 23/00*** | (2006.01) |
| ***F04C 27/00*** | (2006.01) |
| *F04C 29/02* | (2006.01) |

(52) U.S. Cl.

CPC ..... *F04C 29/0007* (2013.01); *F04C 29/02* (2013.01); *F04C 2240/50* (2013.01); *Y10S 418/01* (2013.01)

(56) References Cited

U.S. PATENT DOCUMENTS

| | | | | |
|---|---|---|---|---|
| 4,384,831 | A | 5/1983 | Ikegawa et al. | |
| 4,645,437 | A * | 2/1987 | Sakashita | F04C 18/0215 418/55.5 |
| 4,767,293 | A | 8/1988 | Caillat et al. | |
| 4,877,382 | A | 10/1989 | Caillat et al. | |
| 4,993,928 | A | 2/1991 | Fraser, Jr. | |
| 5,156,539 | A | 10/1992 | Anderson et al. | |
| 5,427,511 | A | 6/1995 | Caillat et al. | |
| 5,469,716 | A | 11/1995 | Bass et al. | |
| 5,489,198 | A | 2/1996 | Comparin et al. | |
| 5,674,061 | A | 10/1997 | Motegi et al. | |
| 6,086,335 | A | 7/2000 | Bass et al. | |
| 6,146,119 | A | 11/2000 | Bush et al. | |
| 6,416,301 | B2 | 7/2002 | Bush et al. | |
| 6,430,959 | B1 | 8/2002 | Lifson | |
| 6,457,948 | B1 | 10/2002 | Pham | |
| 6,527,528 | B1 | 3/2003 | Barito et al. | |
| 6,695,599 | B2 | 2/2004 | Uchida et al. | |
| 7,195,470 | B2 | 3/2007 | Kimura et al. | |
| 7,837,452 | B2 | 11/2010 | Ignatiev et al. | |
| 2005/0135956 | A1 | 6/2005 | Kimura et al. | |
| 2006/0266076 | A1 | 11/2006 | Lifson | |

FOREIGN PATENT DOCUMENTS

| | | | | |
|---|---|---|---|---|
| CN | 1382912 | A | 12/2002 | |
| CN | 1517553 | A | 8/2004 | |
| CN | 1629485 | A | 6/2005 | |
| JP | 56056991 | A | 5/1981 | |
| JP | 62003184 | A | 1/1987 | |
| JP | 63131889 | A | 6/1988 | |
| JP | 1177479 | A | 7/1989 | |
| JP | 03088988 | | 4/1991 | |
| JP | 05001677 | A | 1/1993 | |
| JP | 6173864 | A | 6/1994 | |
| JP | 2002122083 | A | 4/2002 | |
| JP | 2002202076 | A | 7/2002 | |
| JP | 2003328962 | A | 11/2003 | |
| JP | 2004232481 | A * | 8/2004 | F04C 18/0215 |
| JP | 2005180321 | A | 7/2005 | |
| JP | H04066701 | | 2/2014 | |
| WO | 2004010001 | A1 | 1/2004 | |

OTHER PUBLICATIONS

Aperture / Definition of Aperture by Merriam-Webster—http://www.merriam-webster.com/dictionary/aperture—Mar. 20, 2016.*

First Office Action received from the State Intellectual Property Office of People's Republic of China dated Oct. 23, 2009 regarding Application No. 2006800398775. Translation provided by Unitalen Attorneys at Law.

International Search Report and Written Opinion of the International Searching Authority for International Application No. PCT/US2006/039753 dated Feb. 21, 2007 (7 pages).

International Preliminary Report on Patentability for International Application No. PCT/US2006/039753 dated Apr. 29, 2008 (5 pages).

Non-Final Office Action issued by U.S. Patent and Trademark Office dated Apr. 25, 2008 from related U.S. Appl. No. 11/259,237, filed Oct. 26, 2005, entitled "Scroll Compressor" (10 pages).

Final Office Action issued by U.S. Patent and Trademark Office dated Oct. 31, 2008 from related U.S. Appl. No. 11/259,237, filed Oct. 26, 2005, entitled "Scroll Compressor" (8 pages).

Office Action issued by U.S. Patent and Trademark Office dated Feb. 18, 2010 from related U.S. Appl. No. 12/420,519, filed Apr. 8, 2009, entitled "Scroll Compressor Including Deflection Compensation for Non-Orbiting Scroll" (15 pages).

Non-final Office Action regarding U.S. Appl. No. 12/938,848 mailed Jan. 6, 2012.

Non-final Office Action issued by the U.S. Patent and Trademark Office regarding U.S. Appl. No. 12/938,848 mailed Aug. 17, 2011.

Second Office Action received from the State Intellectual Property Office of People's Republic of China, dated Jan. 20, 2012, regarding Application No. 2006800398775. Translation provided by Unitalen Attorneys at Law.

U.S. Office Action regarding U.S. Appl. No. 13/528,285 mailed Jul. 1, 2013.

European Search Report regarding Application No. 06816736.0-1608 / 1941162 PCT/US2006039753, dated Oct. 31, 2013.

First Office Action and Search Report issued by the State Intellectual Property Office (SIPO) regarding China Application No. 201210193771.8 dated Apr. 1, 2014. Translation provided by Unitalen Attorneys at Law.

First Office Action and Search Report issued by the State Intellectual Property Office (SIPO) regarding China Application No. 2012101939569 dated Apr. 1, 2014. Translation provided by Unitalen Attorneys at Law.

Second Office Action regarding China Application No. 201210193956.0 dated Dec. 3, 2014. Translation provided by Unitalen Attorneys at Law.

Second Office Action regarding China Application No. 201210193771.8 dated Dec. 18, 2014. Translation provided by Unitalen Attorneys at Law.

* cited by examiner

SCROLL COMPRESSOR HAVING BIASING SYSTEM

CROSS REFERENCE TO RELATED APPLICATIONS

This application is a continuation of U.S. patent application Ser. No. 13/528,285 filed on Jun. 20, 2012, which is a continuation of U.S. patent application Ser. No. 12/938,848 filed on Nov. 3, 2010, now U.S. Pat. No. 8,226,387, which is a continuation of U.S. patent application Ser. No. 12/420,519 filed on Apr. 8, 2009, now U.S. Pat. No. 7,837,452, which is a continuation of U.S. patent application Ser. No. 11/259,237 filed on Oct. 26, 2005, now abandoned. The disclosure of each of the above applications is incorporated herein by reference.

FIELD

The present disclosure is directed toward a scroll compressor.

BACKGROUND AND SUMMARY

A class of machines exists in the art generally known as "scroll" machines for the displacement of various types of fluids. Such machines may be configured as an expander, a displacement engine, a pump, a compressor, etc., and the features of the present invention are applicable to any one of these machines. For purposes of illustration, however, the disclosed embodiments are in the form of a hermetic refrigerant compressor.

Generally speaking, a scroll machine comprises two spiral scroll wraps of similar configuration, each mounted on a separate end plate to define a scroll member. The two scroll members are interfitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective wraps, defining moving isolated crescent-shaped pockets of fluid. The spirals are commonly formed as involutes of a circle, and ideally there is no relative rotation between the scroll members during operation; i.e., the motion is purely curvilinear translation (i.e., no rotation of any line in the body). The fluid pockets carry the fluid to be handled from a first zone in the scroll machine where a fluid inlet is provided, to a second zone in the machine where a fluid outlet is provided. The volume of a sealed pocket changes as it moves from the first zone to the second zone. At any one instant in time there will be at least one pair of sealed pockets; and where there are several pairs of sealed pockets at one time, each pair will have different volumes. In a compressor, the second zone is at a higher pressure than the first zone and is physically located centrally in the machine, the first zone being located at the outer periphery of the machine.

A compressor may include a shell assembly, a first scroll member located within the shell assembly and including a first end plate and a first spiral wrap extending from the first end plate, and a second scroll member located within the shell assembly, supported for orbital movement relative to the first scroll member and including a second end plate and a second spiral wrap extending from the second end plate and meshingly engaged with the first spiral wrap to form compression pockets. The first scroll member may define a fluid injection port and the second scroll member may define a passage in communication with the fluid injection port and at least one of the compression pockets to provide pressurized vapor from the fluid injection port to the at least one of the compression pockets.

The compressor may additionally include a drive shaft engaged with the second scroll member and the fluid injection port may extend through the first end plate and the passage may extend through the second end plate and may be intermittently in communication with the fluid injection port. Initial communication between the fluid injection port and the passage may occur just after an outermost one of the compression pockets is formed by being sealed off from a suction pressure region of the shell assembly. Communication between the fluid injection port and the passage may be terminated after ninety degrees of rotation of the drive shaft after the initial communication between the fluid injection port and the passage occurs. Communication between the fluid injection port and the passage may be terminated after ninety degrees of rotation of the drive shaft after an outermost one of the compression pockets is formed by being sealed off from a suction pressure region of the shell assembly. The first scroll member may be axially fixed relative to the shell assembly and the second scroll member may be axially displaceable relative to the shell assembly and the first scroll member.

The passage may include a first axial passage extending partially through the second end plate and in communication with the fluid injection port, a radial passage extending from the first axial passage through the second end plate and a second axial passage extending from the radial passage and in communication with the at least one of the compression pockets. The compressor may include a third axial passage extending from the radial passage and in communication with another one of the compression pockets.

The compressor may additionally include a vapor injection system having a pressurized vapor source in communication with the fluid injection port. The shell assembly may include an end cap and the vapor injection system may include a fluid line extending through the end cap and providing the pressurized vapor source to the fluid injection port. The compressor may include a drive shaft engaged with the second scroll member and the fluid injection port may extend through the first end plate and the passage may extend through the second end plate and may be intermittently in communication with the fluid injection port. Initial communication between the fluid injection port and the passage may occur just after an outermost one of the compression pockets is formed by being sealed off from a suction pressure region of the shell assembly. Communication between the fluid injection port and the passage may be terminated after ninety degrees of rotation of the drive shaft after the initial communication between the fluid injection port and the passage occurs. Communication between the fluid injection port and the passage may be terminated after ninety degrees of rotation of the drive shaft after an outermost one of the compression pockets is formed by being sealed off from a suction pressure region of the shell assembly. The first scroll member may be axially fixed relative to the shell assembly and the second scroll member may be axially displaceable relative to the shell assembly and the first scroll member.

In another form, the present disclosure provides a compressor that includes a non-orbiting scroll, an orbiting scroll, and a bearing housing. The non-orbiting scroll may include a recess. The orbiting scroll may be intermeshed with the non-orbiting scroll to from a plurality of compression pockets therebetween. The orbiting scroll may include first and second apertures. The first aperture may communicate with one of the compression pockets. The second aperture may communicate with the recess. The bearing housing may support the orbiting scroll and cooperate with the orbiting scroll to define a chamber therebetween. The chamber may communicate with the first and second apertures.

BRIEF DESCRIPTION OF THE DRAWINGS

The present disclosure will become more fully understood from the detailed description and the accompanying drawings, wherein.

DETAILED DESCRIPTION

The following description of the preferred embodiments is merely exemplary in nature and is in no way intended to limit the invention, its application, or uses.

Figure 1:
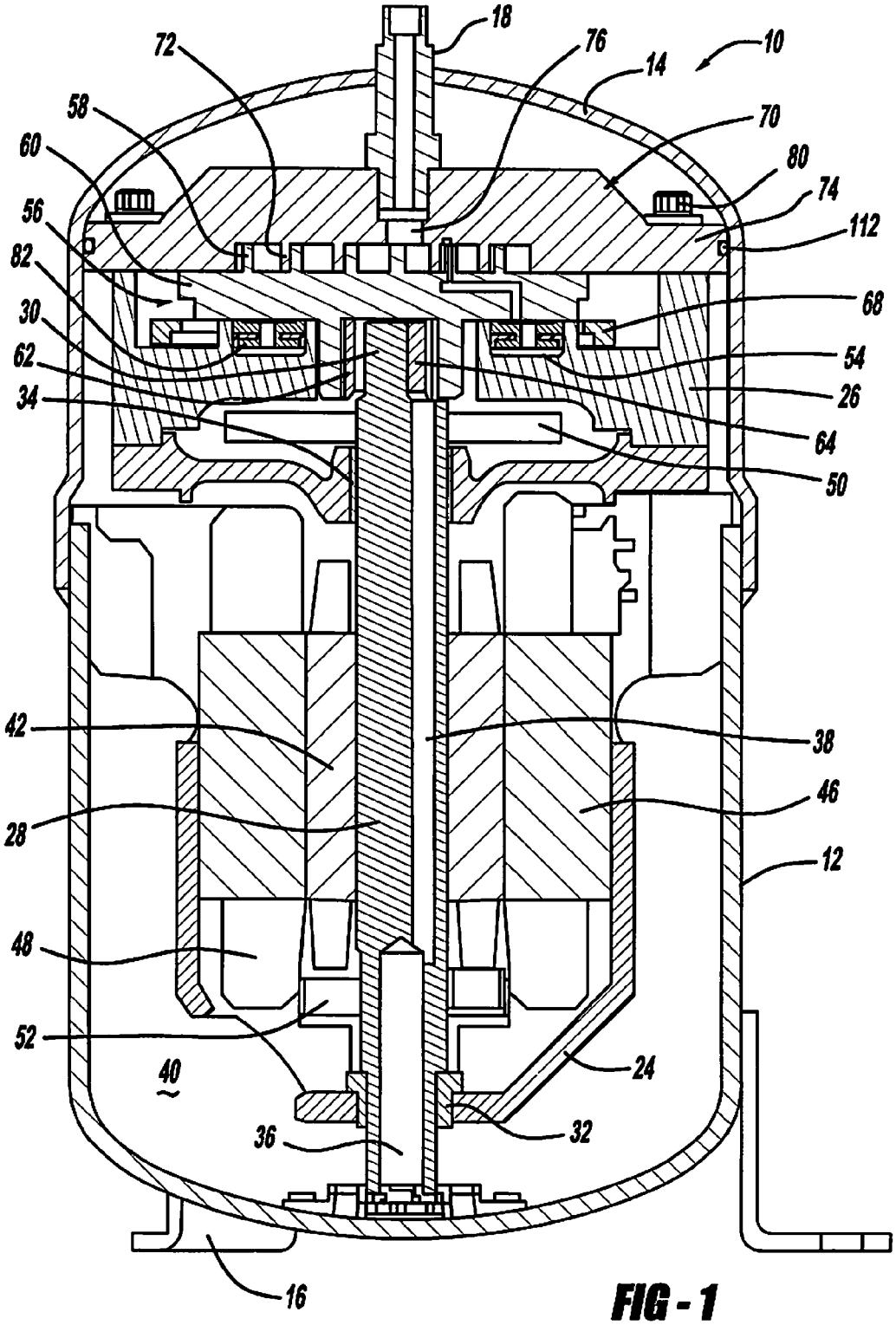
FIG. 1 is a vertical cross section of a scroll compressor in accordance with the present teachings.
Figure 2:
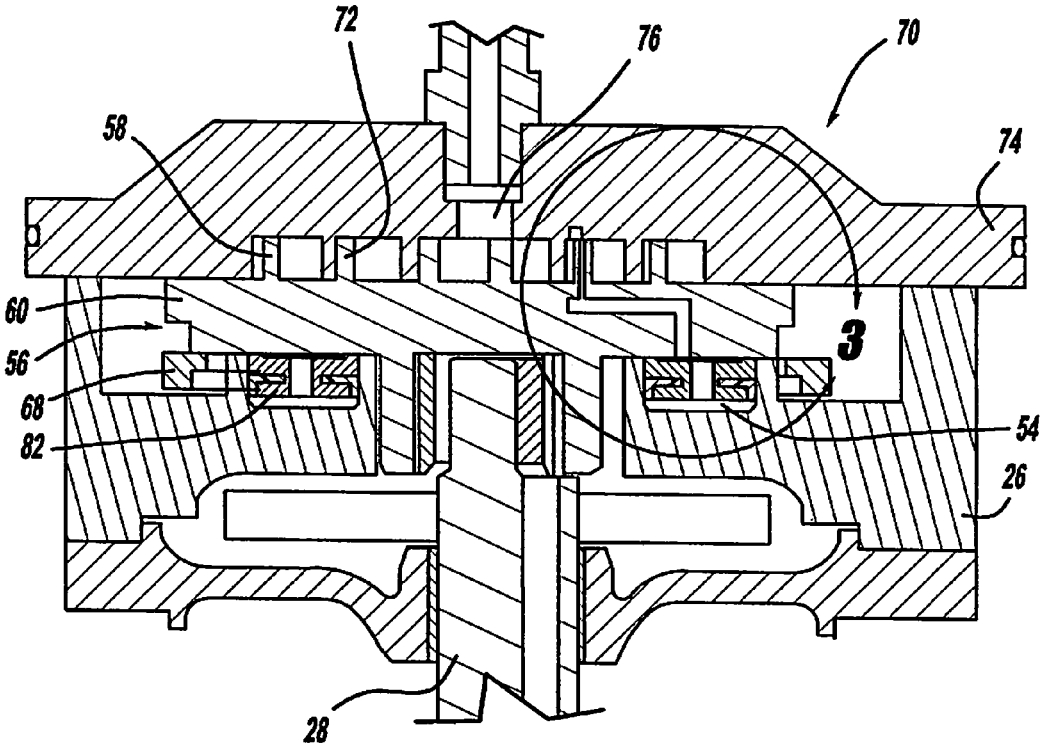
FIG. 2 is an enlarged view of the scroll members of the scroll compressor illustrated in FIG. 1 showing the biasing system.

Referring now to the drawings in which like reference numerals designate like or corresponding parts throughout the several views, there is shown in FIG. 1 a scroll compressor in accordance with the present invention and which is designated generally by reference numeral 10. Compressor 10 comprises a generally cylindrical hermetic shell 12 having welded at the upper end thereof a cap 14 and at the lower end thereof a plurality of mounting feet 16. Cap 14 is provided with a refrigerant discharge fitting 18. Other major elements affixed to shell 12 include a lower bearing housing 24 that is suitably secured to shell 12 and a two piece upper bearing housing 26 suitably secured to lower bearing housing 24.

A drive shaft or crankshaft 28 having an eccentric crank pin 30 at the upper end thereof is rotatably journaled in a bearing 32 in lower bearing housing 24 and a second bearing 34 in upper bearing housing 26. Crankshaft 28 has at the lower end a relatively large diameter concentric bore 36 that communicates with a radially outwardly inclined smaller diameter bore 38 extending upwardly therefrom to the top of crankshaft 28. The lower portion of the interior shell 12 defines an oil sump 40 that is filled with lubricating oil to a level slightly above the lower end of a rotor 42, and bore 36 acts as a pump to pump lubricating fluid up crankshaft 28 and into bore 38 and ultimately to all of the various portions of the compressor that require lubrication.

Crankshaft 28 is rotatively driven by an electric motor including a stator 46, windings 48 passing therethrough and rotor 42 press fitted on crankshaft 28 and having upper and lower counterweights 50 and 52, respectively.

The upper surface of upper bearing housing 26 is provided with an annular recess 54 above which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journaled bearing 62 therein and in which is rotatively disposed a drive bushing 64 having an inner bore in which crank pin 30 is drivingly disposed. Crank pin 30 has a flat on one surface that drivingly engages a flat surface (not shown) formed in a portion of the bore to provide a radially compliant driving arrangement, such as shown in Assignee's U.S. Pat. No. 4,877,382, the disclosure of which is hereby incorporated herein by reference. An Oldham coupling 68 is also provided positioned between orbiting scroll member 56 and upper bearing housing 26 and keyed to orbiting scroll member 56 and upper bearing housing 26 to prevent rotational movement of orbiting scroll member 56.

A non-orbiting scroll member 70 is also provided having a scroll wrap 72 extending downwardly from an end plate 74 that is positioned in meshing engagement with wrap 58 of orbiting scroll member 56. Non-orbiting scroll member 70 has a centrally disposed discharge passage 76 that communicates with discharge fitting 18 which extends through end cap 14.

Referring now to FIGS. 1-3*a*, orbiting scroll member 56 and non-orbiting scroll member 70 are illustrated in greater detail. Non-orbiting scroll member 70 is fixedly secured to two-piece upper bearing housing 26 by a plurality of bolts 80 which prohibit all movement of non-orbiting scroll member 70 with respect to upper bearing housing 26. Orbiting scroll member 56 is disposed between non-orbiting scroll member 70 and upper bearing housing 26. Orbiting scroll member 56 can move radially as described above in relation to the radially compliant drive for compressor 10. Orbiting scroll member 56 can also move axially by means of a floating thrust seal 82 disposed within annular recess 54.

Floating thrust seal 82 comprises an annular valve body 84, an inner lip seal 86 and an outer lip seal 88. Annular valve body 84 defines an inner face seal 90 and an outer face seal 92 which are urged against end plate 60 of orbiting scroll member 56 by fluid pressure supplied to recess 54 through a plurality of passages 94 extending through annular valve body 84. Inner lip seal 86 seals against an inner wall of recess 54, outer lip seal 88 seals against an outer wall of recess 54 and face seals 90 and 92 seal against end plate 60 of orbiting scroll member 56 to isolate recess 54 from suction pressure refrigerant within shell 12. The design parameters for floating thrust seal 82 are selected in such a way that, under internal pressurization, annular valve body 84 stays in constant contact with end plate 60 or orbiting scroll member 56 by means of face seals 90 and 92. The majority of the axial biasing load applied to orbiting scroll member 56 is supplied by the refrigerant gas pressure within recess 54 rather than by mechanical contact between face seals 90 and 92 and end plate 60 of orbiting scroll member 56. This reduces mechanical friction and wear of face seals 90 and 92 and the corresponding surface of end plate 60 of orbiting scroll member 56. Pressurization of recess 54 is achieved using one or more passages 96 which extend from an area of end plate 60 open to recess 54 through end plate 60 and through scroll wrap 58 of orbiting scroll member 56.

Figure 3A:
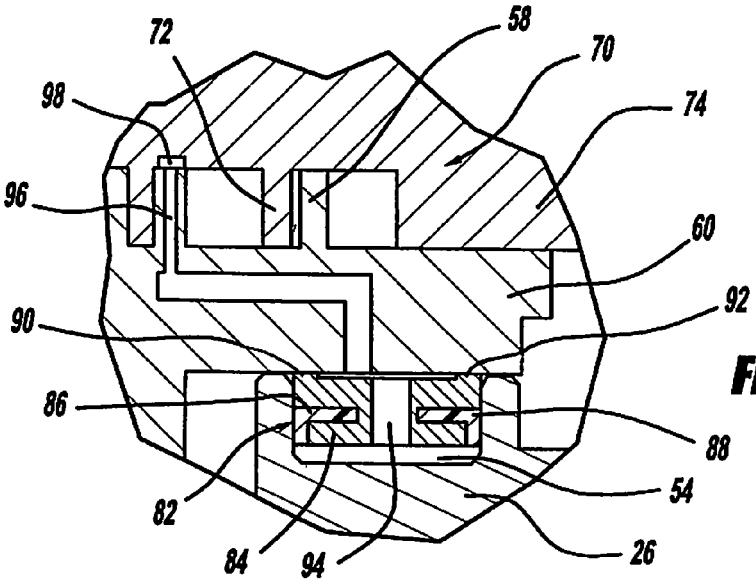
FIG. 3*a* is an enlarged view of the biasing system illustrated in FIG. 1.
Figure 3B:
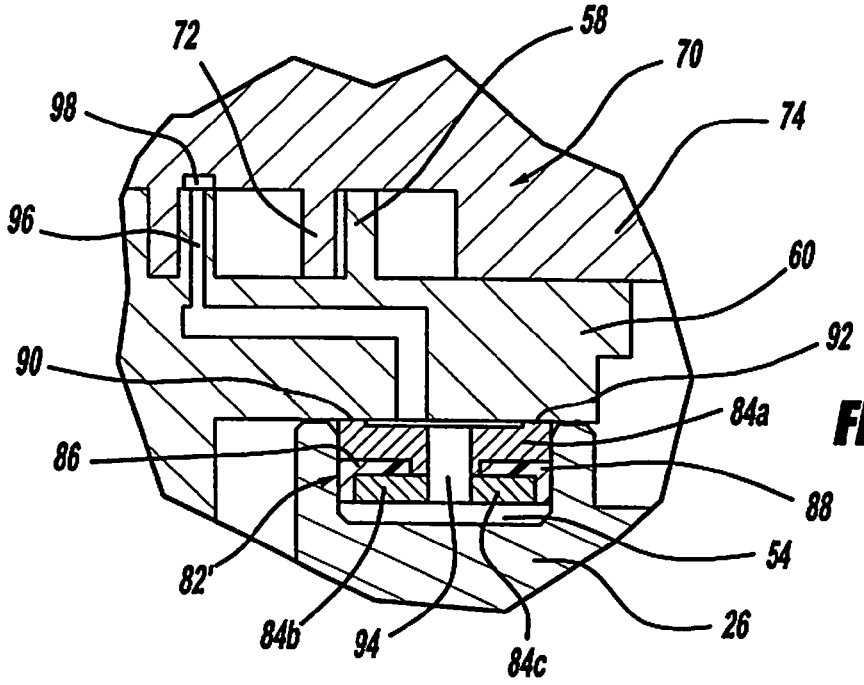
FIG. 3*b* is an enlarged view of a biasing system in accordance with another embodiment of the present invention.

Referring now to FIG. 3*b*, a biasing system in accordance with another embodiment of the present invention is disclosed. FIG. 3*b* illustrates floating thrust seal 82' which is the same as floating thrust seal 82 except that annular valve body 84 is replaced by a three piece annular body 84*a*, 84*b* and 84*c*.

Floating thrust seal 82' comprises annular valve bodies 84*a*, 84*b* and 84*c*, an inner lip seal 86 and an outer lip seal 88. Annular valve body 84*a* defines an inner face seal 90 and an outer face seal 92 which are urged against end plate 60 of orbiting scroll member 56 by fluid pressure supplied to recess 54 through a plurality of passages 94 extending through annular valve body 84*a*. Inner lip seal 86 is located between annular valve body 84*a* and 84*b* and it seals against an inner wall of recess 54, outer lip seal 88 is located between annular valve body 84*a* and 84*c* and it seals against an outer wall of recess 54 and face seals 90 and 92 seal against end plate 60 of orbiting scroll member 56 to isolate recess 54 from suction pressure refrigerant within shell 12. The use of the three piece annular valve bodies 84*a*, 84*b* and 84*c* allows lip seals 86 and 88 to operate independently from each other. The design parameters for floating thrust seal 82 are selected in such a way that, under internal pressurization, annular valve body 84*a* stays in constant contact with end plate 60 or orbiting scroll member 56 by means of face seals 90 and 92. The majority of the axial biasing load applied to orbiting scroll member 56 is supplied by the refrigerant gas pressure within recess 54 rather than by mechanical contact between face seals 90 and 92 and end plate 60 of orbiting scroll member 56. This reduces mechanical friction and wear of face seals 90 and 92 and the corresponding surface of end plate 60 of orbiting scroll member 56. Pressurization of recess 54 is achieved using one or more passages 96 which extend from an area of end plate 60 open to recess 54 through end plate 60 and through scroll wrap 58 of orbiting scroll member 56.

Figure 4A:
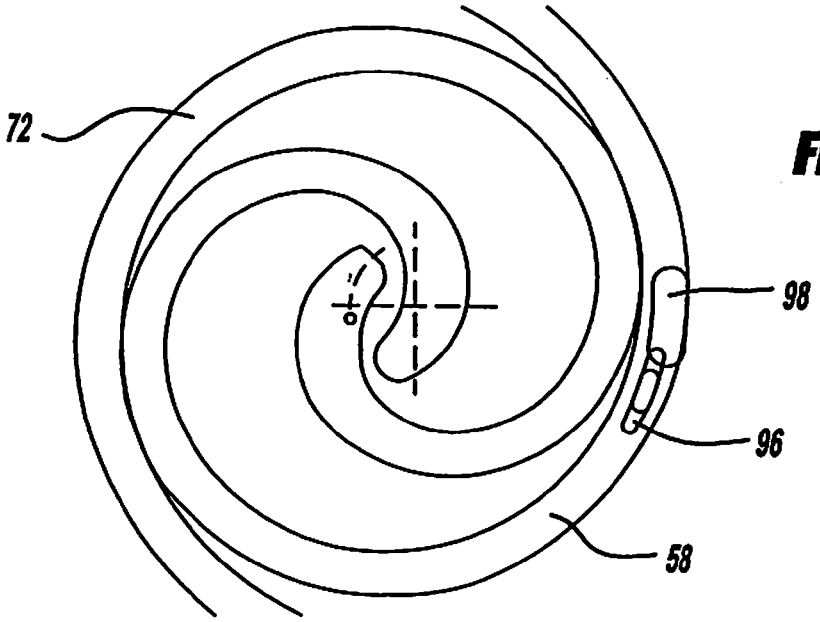
FIGS. 4*a*-4*c* are plan views of the scroll members and the biasing system illustrated in FIG. 3*a;*
Figure 4B:
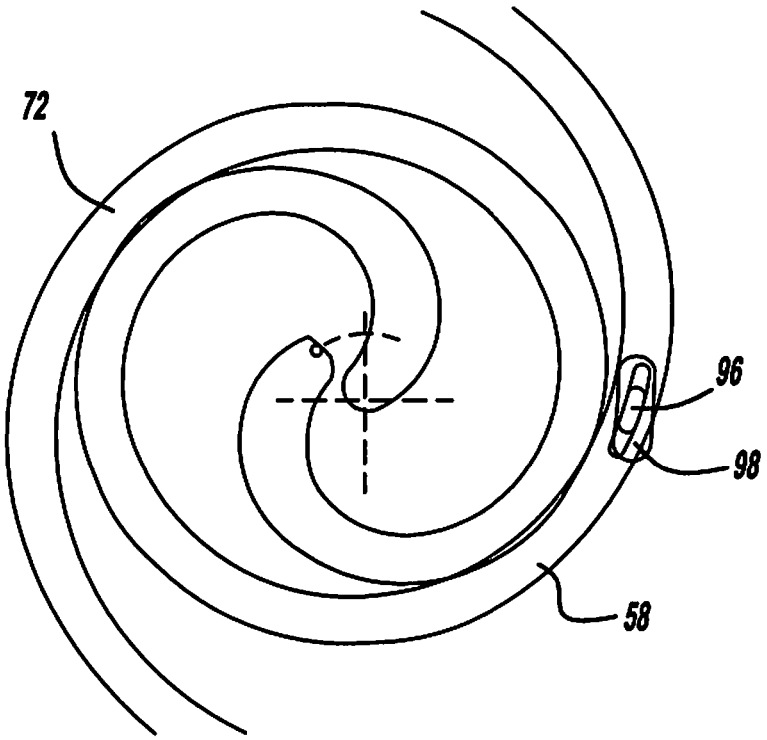
Figure 4C:
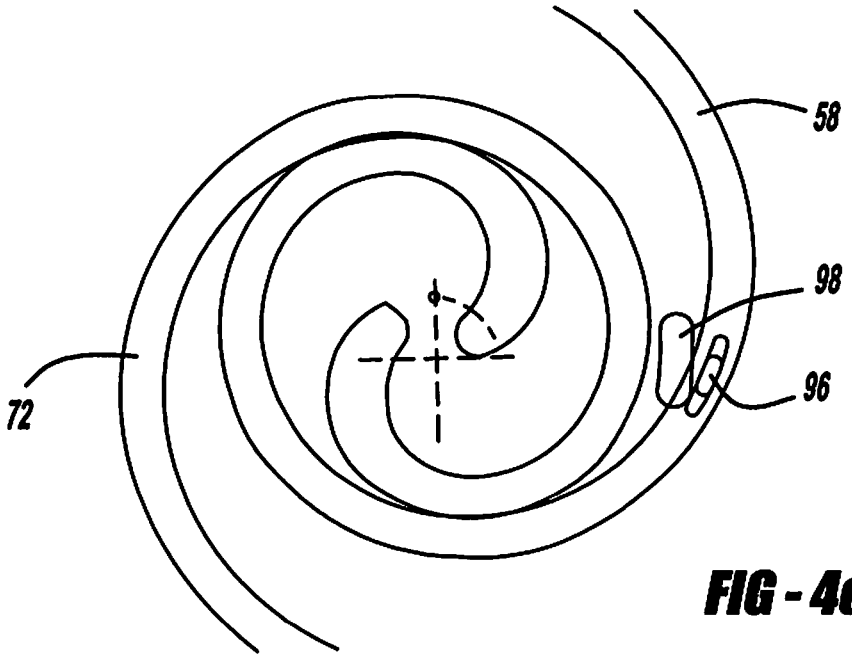

During orbiting motion of orbiting scroll member 56 with respect to non-orbiting scroll member 70, the end of the one or more passages 96 extending through scroll wrap 58 connects to one of the moving pockets defined by scroll wraps 58 and 72 by means of a recess 98 which is machined into end plate 74 of non-orbiting scroll member 70. The location, size and shape of the one or more passages 96 and recess 98 will determine the opening and closing of gas communication between the compressed gas in the moving pocket and recess 54. In addition, the transition time of the pressure equalization between the moving pocket and recess 54 is controlled by the location, size and shape of the one or more passages 96 and recess 98. The timing of the opening and closing in conjunction with the transition time can be selected such that it will minimize excessive axial force applied to end plate 60 of orbiting scroll member 56 but at the same time the axial force will keep orbiting scroll member 56 in constant contact with non-orbiting scroll member 70. FIG. 4*a* illustrates the beginning of the opening of communication, FIG. 4*b* illustrates an opened communication and FIG. 4*c* illustrates the closing of communication between recess 98 and one passage 96.

Figure 5:
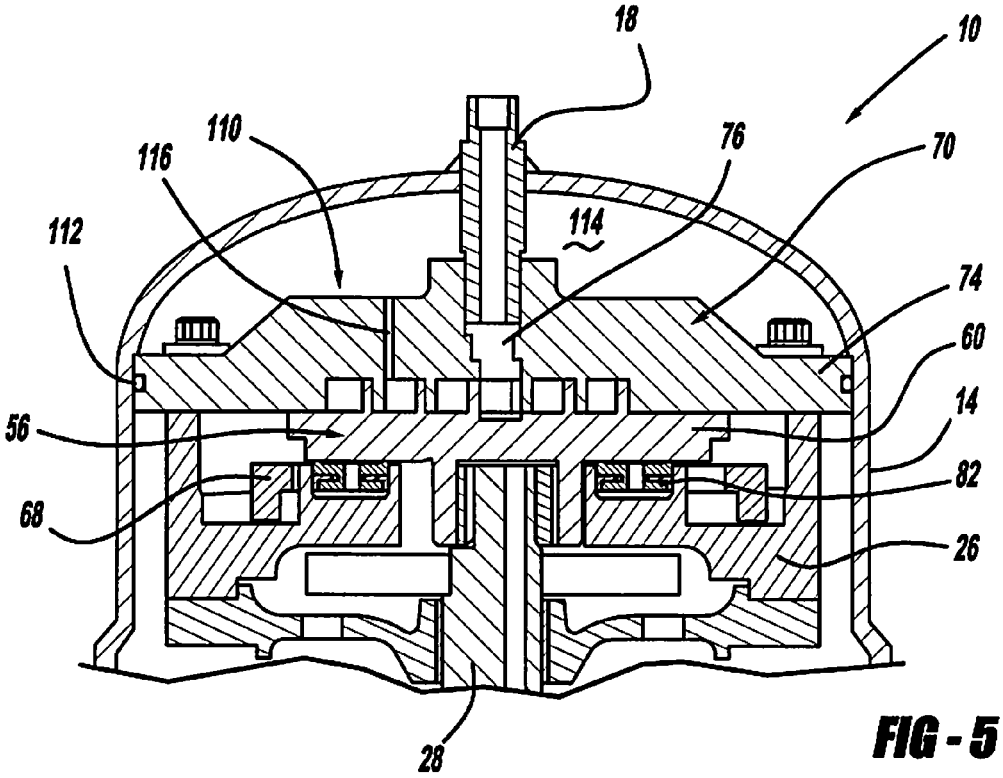
FIG. 5 is an enlarged view of the scroll members of the scroll compressor illustrated in FIG. 1 showing the pressurization port.
Figure 6:
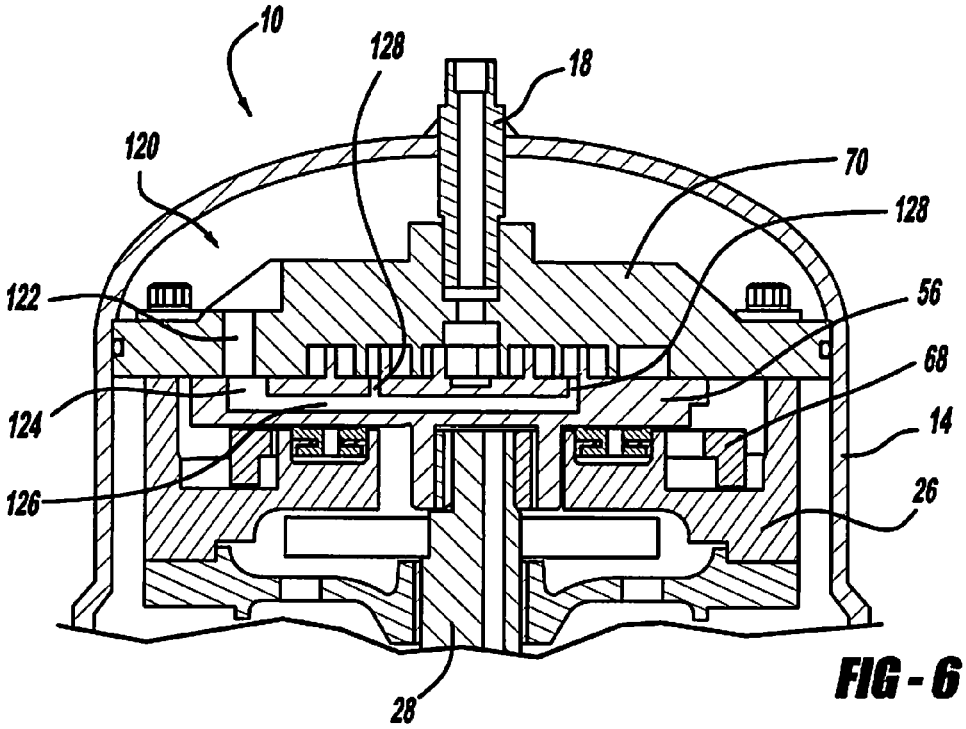
FIG. 6 is an enlarged view of the scroll members of the scroll compressor illustrated in FIG. 1 showing an optional vapor injection system.

Referring now to FIG. 5, an axial pressure biasing system 110 is illustrated. During the operation of compressor 10, suction gas is sucked into scroll members 56 and 70 where it is compressed and then discharged from discharge passage 76 through discharge fitting 18 that extends through cap 14. Because the axial force from the compressed gas is located primarily in the center of orbiting scroll member 56, and axial support for orbiting scroll member 56 from floating thrust seal 82 is located at the periphery of orbiting scroll member 56, end plate 60 of orbiting scroll member 56 experiences bending such that the upper surface of end plate 60 becomes concave. At the same time, due to the thermal field, orbiting scroll wrap 58 as well as non-orbiting scroll wrap 72 are experiencing thermal growth, with the higher growth being in the center of scroll members 56 and 70. The lower surface of end plate 74 of non-orbiting scroll member 70 also becomes concave due to the axial separating force from the compressed gas in the moving pockets. However, gas pressure behind end plate 74 of non-orbiting scroll member 70 can also influence the deflection of end plate 74.

Non-orbiting scroll member 70 is sealingly secured to end cap 14 using a seal 112. Non-orbiting scroll member 70 and end cap 14 define a pressure chamber 114 which is supplied intermediate pressurized gas from one or more of the moving pockets defined by wraps 58 and 72 through a passage 116 extending through end plate 74. At a given operating condition, determined by suction and discharge pressure, it is possible to determine the value of gas pressure in pressure chamber 114. The gas pressure in pressure chamber 114 influences the deflection of end plate 74 in such a way that the tips of orbiting scroll wrap 58 as well as the tips of non-orbiting scroll wrap 72 will be as close to a uniform contact as possible. The necessary gas pressure to achieve the uniform contact with the respective end plates 60 and 74 can be selected by properly positioning passage 116 in end plate 74.

Referring now to FIGS. 6 and 7*a*-7*c*, a vapor injection system 120 in accordance with the present invention is illustrated. The source for vapor injection is located external to compressor 10 and it is supplied from a fluid line (not shown) which extends through cap 14. Non-orbiting scroll member 70 defines a fluid injection port 122 to which the fluid line is attached to supply the pressurized vapor to scroll members 56 and 70. Fluid injection port 122 is in communication with an axial passage 124 in orbiting scroll member 56. Axial passage 124 is in communication with a radial passage 126 which is in turn in communication with a pair of axial passages 128 which open into the moving fluid pockets defined by scroll wraps 58 and 72. In order to achieve the necessary amount of vapor introduced into the moving pockets, opening and closing of communication between port 122 and passage 124 must be controlled. The opening of port 122 to passage 124 should begin just after the moving pocket is formed by being sealed from the suction area of compressor 10. The closing of port 122 to passage 124 should happen after approximately ninety degrees of rotation of orbiting scroll member 56. Because of the relative orbiting motion of orbiting scroll member 56 with respect to non-orbiting scroll member 70, the proper selection of relative locations of port 122, passage 124 and passages 128 make it possible to control the opening and closing of vapor injection system 120. Opening and closing of vapor injection system 120 to provide vapor to the moving pockets can be achieved by either lowering and uncovering passages 128 on end plate 60 of orbiting scroll member 56 by scroll wrap 72 of non-orbiting scroll member or by opening and closing communication between port 122 and passage 124 or by a combination of both.

Figure 7A:
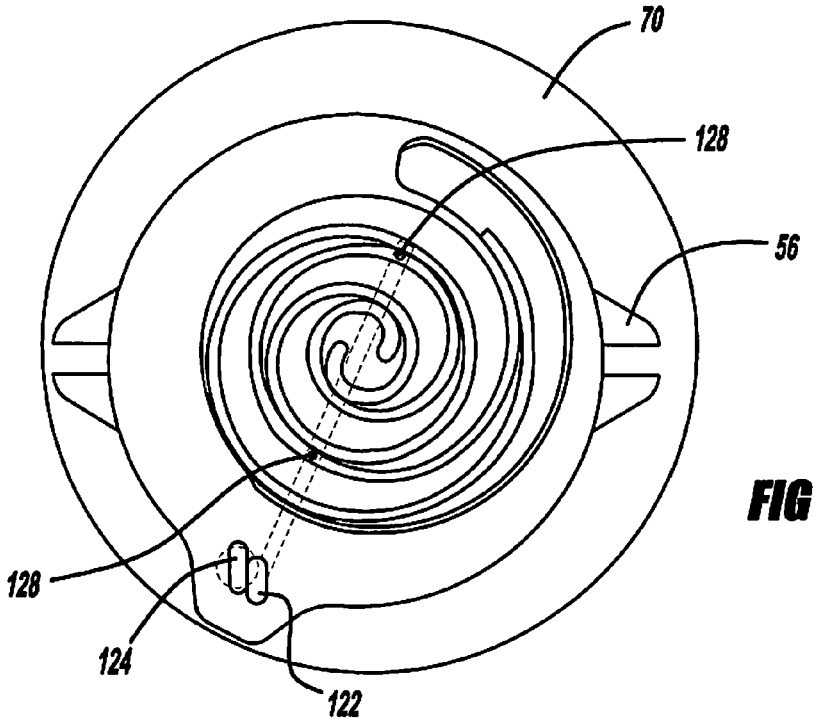
FIGS. 7*a*-7*c* are plan views of the scroll members and the vapor injection system illustrated in FIG. 6.
Figure 7B:
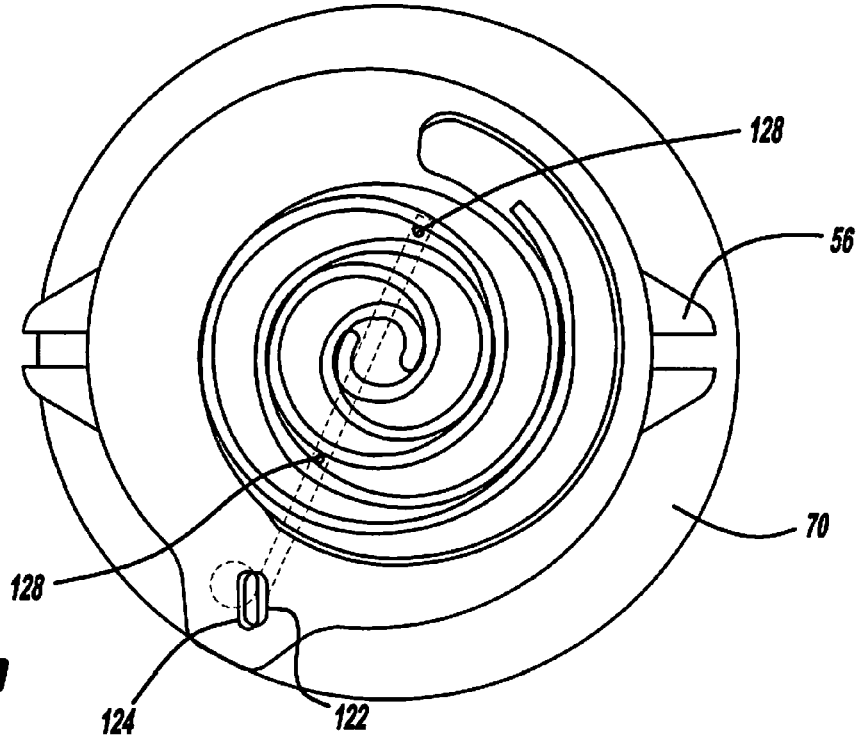
Figure 7C:
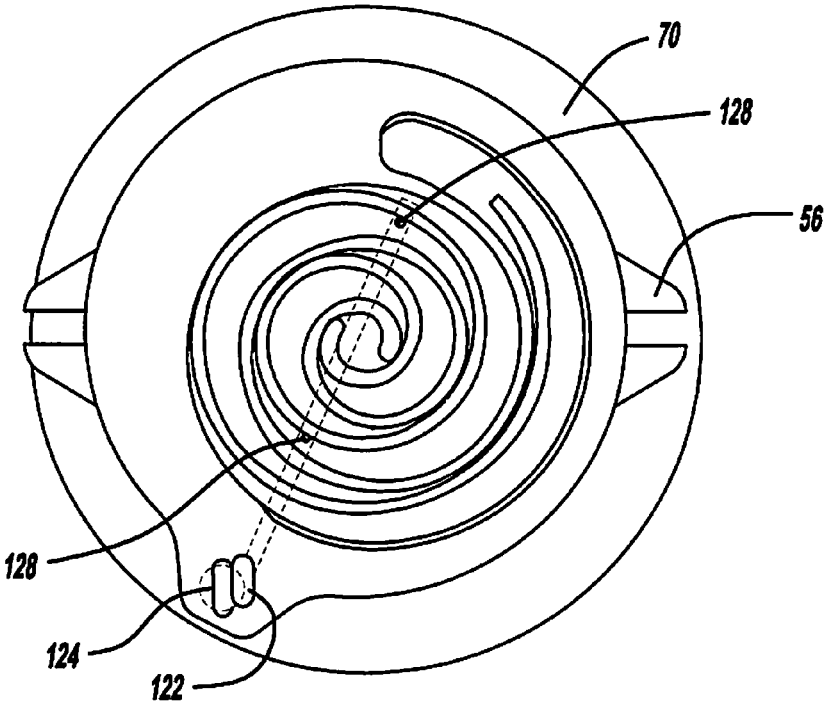

FIG. 7*a* illustrates scroll members 56 and 70 corresponding to the point where the moving pockets defined by scroll wraps 58 and 72 are initially sealed off from the suction area of compressor 10. Communication between port 122 and passage 124 is just starting to take place and passages 128 are just beginning to be uncovered by scroll wrap 72. FIG. 7*b* illustrates scroll members 56 and 70 corresponding to the position forty-five degrees of rotation after the initial sealing point illustrated in FIG. 7*a*. Port 122 is open to passage 124 and passages 128 are not covered by scroll wrap 72 to provide for vapor injection. FIG. 7*c* illustrates scroll members 56 and 70 corresponding to the position ninety degrees of rotation after the initial sealing paint illustrated in FIG. 7*a*. Port 122 has just closed communication with passage 124 to stop vapor injection by vapor injection system 120.

Figure 8:
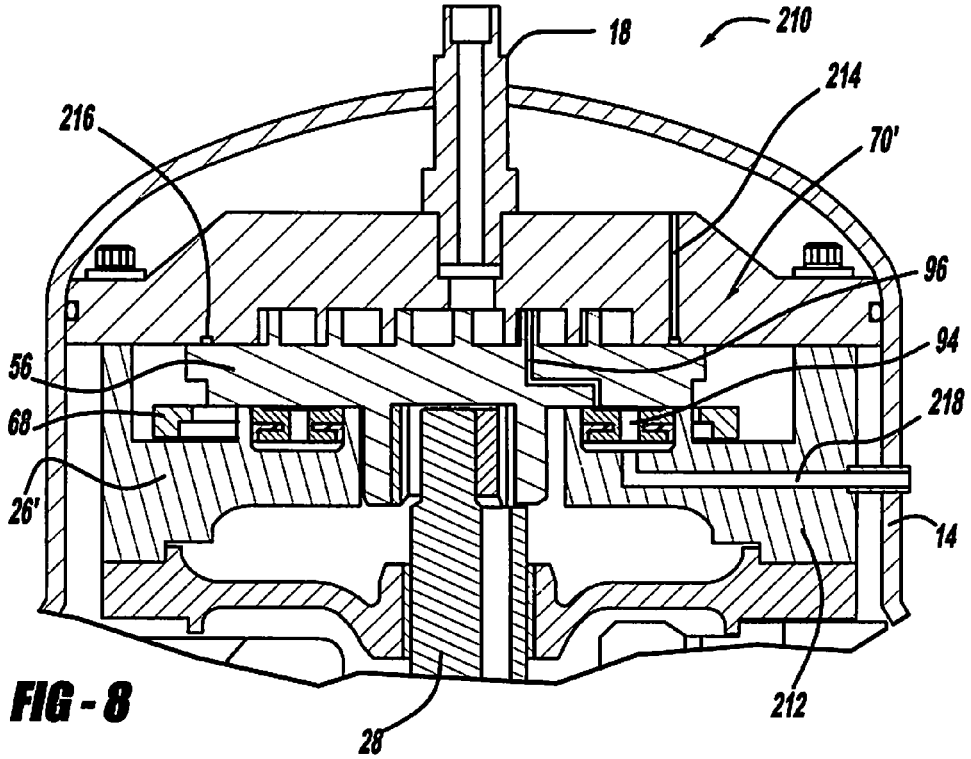
FIG. 8 is an enlarged view of the scroll members of the scroll compressor illustrated in FIG. 1 showing an optional high pressure oil biasing system.
Figure 9:
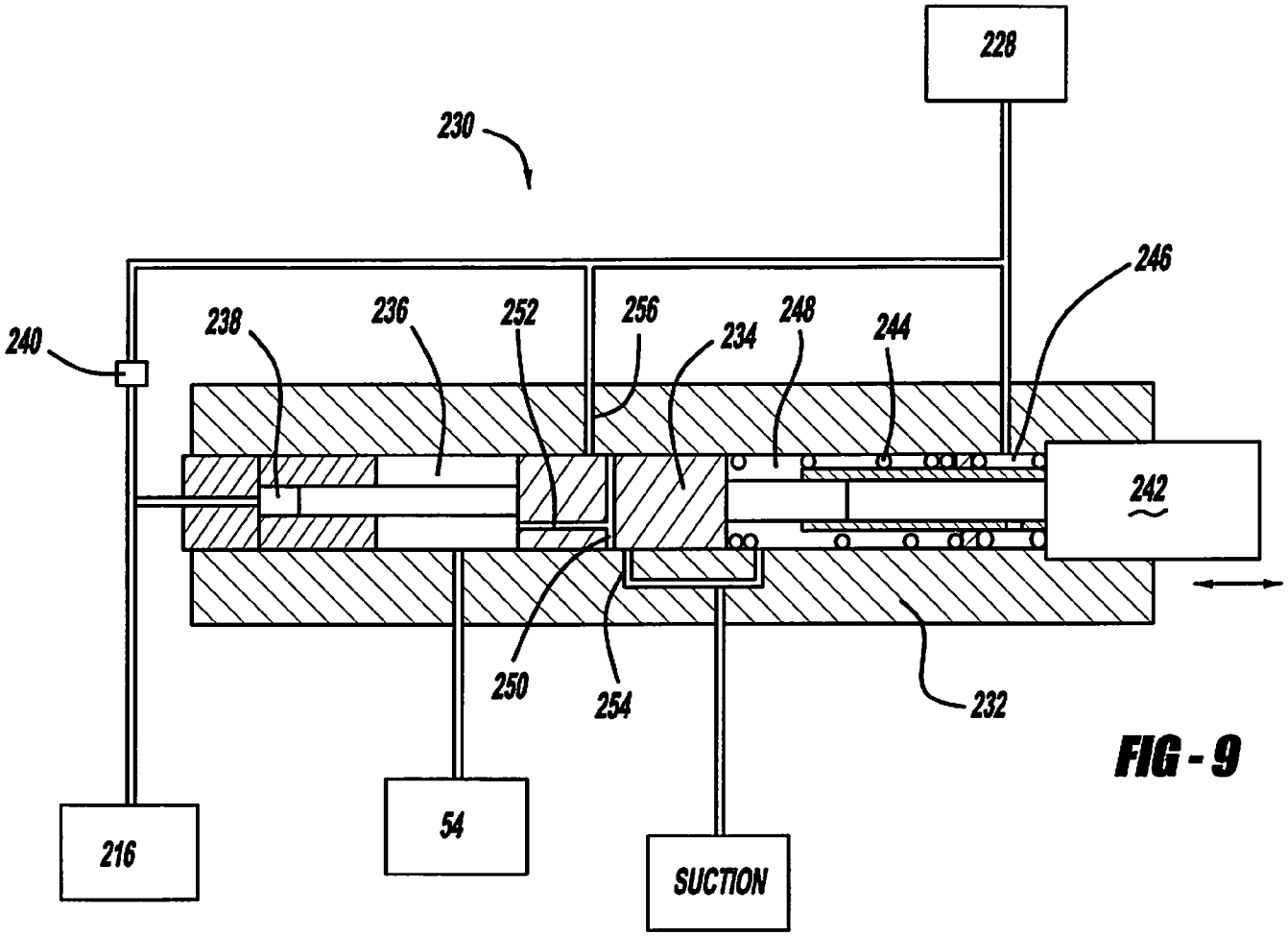
FIG. 9 is a side cross-sectional view of an oil pressure regulator used for the optional oil pressure biasing system for the compressor illustrated in FIG. 8.

Referring now to FIGS. 8 and 9, a scroll compressor 210 in accordance with another embodiment of the present invention is illustrated. Scroll compressor 210 is the same as scroll compressor 10 but scroll compressor 210 includes an optional oil injection system 212. Scroll compressor 210 includes a non-orbiting scroll member 70' which replaces non-orbiting scroll member 70 and a two-piece upper bearing housing 26' which replaces two-piece upper bearing housing 26. Non-orbiting scroll member 70' is the same as non-orbiting scroll member 70 except that non-orbiting scroll member 70' defines an oil pressure passage 214 and an oil pressure groove 216. Upper bearing housing 26' is the same as upper bearing housing 26 except that upper bearing housing 26' defines an oil supply passage 218.

Oil injection system 212 injects oil into the moving chambers defined by scroll wraps 56 and 72 for cooling and lubrication through passage 94 and the one or more passages 96. While passages 94 and 96 are illustrated as being used for oil injection, it is within the scope of the present invention to have additional or other dedicated oil injection ports if desired. Once oil is injected into the moving pockets, it is discharged together with the compressed gas and then separated from the compressed gas in an external oil separator (not shown). The separated oil is then cooled and reinjected into the moving pockets of compressor 210.

A source of high pressure oil or high pressure sump 228 is connected through cap 14 to oil pressure passage 214 to provide high pressure oil to annular recess 54 and floating thrust seal 82. In order to control the pressure of the supplied oil, an external oil pressure regulator 230 is utilized. Also, in order to provide the necessary feed back for regulator 230, oil groove 216 and oil pressure passage 214 are connected through cap 14 to regulator 230. When orbiting scroll member 56 is in tight contact with non-orbiting scroll member 70', groove 216 is sealed from the suction area of compressor 210. However, when scroll axial separation takes place, groove 216 opens to the suction area of compressor 210 to provide a leak path.

Referring now to FIG. 9, oil pressure regulator 230 comprises a housing 232 and a differential piston 234. On the left side of piston 234 as shown in FIG. 9, there is a hydrostatic thrust bearing chamber 236 and a lubrication groove sensing chamber 238. Lubrication groove sensing chamber 238 is connected to oil groove 216 through oil pressure passage 214. Lubrication groove sensing chamber 238 is also connected to high pressure oil sump 228 through a metering orifice 240. To the right of piston 234 as shown in FIG. 9, there is an adjustment piston 242 which is threaded into housing 232. Adjustment piston 242 can be used to adjust the preload of springs 244 which urge piston 234 to the left as shown in FIG. 9. Adjustment piston 242 together with piston 234 form a chamber 246 and a chamber 248.

During operation chamber 246 is connected to high pressure oil sump 228 and chamber 248 to high pressure oil sump 228 and chamber 248 is connected to the suction side of compressor 210. There is a circular groove 250 in piston 234 which is connected by a passage 252 to hydrostatic thrust bearing chamber 236. A radial passage 254 through housing 232 is also connected to the suction side of compressor 210. A second radial passage 256 through housing 232 is connected to high pressure sump 228. During operation, the position of piston 234 is determined by the balance of forces in chambers 236, 238, 246 and 248 and the forces exerted by springs 244. The pressure in chamber 236 is controlled by oil leakage from groove 250 to/from radial passages 254 and 256. This leakage depends on the position of groove 250 relative to the openings of passages 254 and 256. Differential piston diameters, as well as other design parameters, are selected in such a way that the controlled pressure in chamber 236 becomes a proper combination of suction and discharge pressures and spring force resulting in the best possible pressure within annular recess 54 reacting on orbiting scroll member 56 and floating thrust seal 82 to provide the appropriate amount of biasing for orbiting scroll member 56 for the efficient operation of compressor 210. When scroll members 56 and 70' are in tight contact, the oil pressure in circular groove 216 and chamber 238 are close to the design pressure. However, in the event of scroll axial separation, oil leakage from groove 216 to the suction portion of compressor 210 will result in a drop of pressure in groove 216 and chamber 238 due to the presence of metering orifice 240. This changes the force balance equilibrium on piston 234 resulting in groove 250 aligning with passage 256 increasing the oil pressure within chamber 236 by connecting chamber 236 to high pressure sump 228 through passage 252, groove 250 and passage 256. This increased oil pressure is supplied from chamber 236 to annular recess 54 resulting in an increase in the clamping force in order to bring the scrolls back together. With the scrolls back together, the pressure within groove 216 and chamber 238 will return to the pressure of high pressure sump 228 which will move piston 234 to the right as shown in FIG. 9 until groove 250 aligns with passage 254 to bleed the increased pressure within chamber 236 to the suction area of the compressor through passage 252, groove 250 and passage 254. This brings the pressure within chamber 236 and thus annular recess 54 back to the design pressure.

Figure 10:
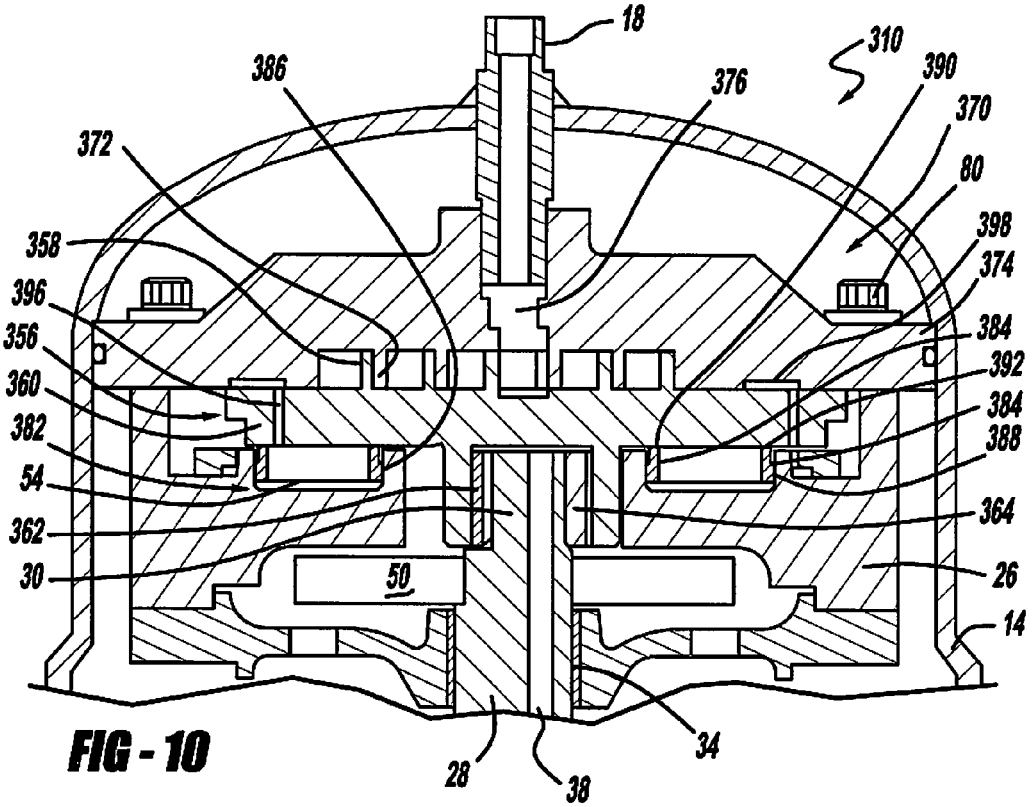
FIG. 10 is an enlarged view of the scroll member of a scroll compressor in accordance with another embodiment of the present invention.

Referring now to FIG. 10, a scroll compressor 310 in accordance with another embodiment of the present invention is illustrated. Scroll compressor 310 is the same as scroll compressor 10 but scroll compressor 310 incorporates a different biasing system for the orbiting scroll member.

Compressor 310 comprises generally cylindrical hermetic shell 12 having welded at the upper end thereof cap 14 and at the lower end thereof the plurality of mounting feet 16. Cap 14 is provided with refrigerant discharge fitting 18. Other major elements affixed to shell 12 include lower bearing housing 24 that is suitably secured to shell 12 and two piece upper bearing housing 26 suitably secured to lower bearing housing 24.

Drive shaft or crankshaft 28 having eccentric crank pin 30 at the upper end thereof is rotatably journaled in bearing 32 in lower bearing housing 24 and second bearing 34 in upper bearing housing 26. Crankshaft 28 has at the lower end the relatively large diameter concentric bore 36 that communicates with radially outwardly inclined smaller diameter bore 38 extending upwardly therefrom to the top of crankshaft 28. The lower portion of the interior shell 12 defines oil sump 40 that is filled with lubricating oil to a level slightly above the lower end of rotor 42, and bore 36 acts as a pump to pump lubricating fluid up crankshaft 28 and into bore 38 and ultimately to all of the various portions of the compressor that require lubrication.

Crankshaft 28 is rotatively driven by the electric motor including stator 46, winding 48 passing therethrough and rotor 42 press fitted on crankshaft 28 and having upper and lower counterweights 50 and 52, respectively.

The upper surface of upper bearing housing 26 is provided with annular recess 54 above which is disposed an orbiting scroll member 356 having the usual spiral vane or wrap 358 extending upward from an end plate 360. Projecting downwardly from the lower surface of end plate 360 of orbiting scroll member 356 is a cylindrical hub having a journaled bearing 362 therein and in which is rotatively disposed drive bushing 64 having an inner bore in which crank pin 30 is drivingly disposed. Crank pin 30 has a flat on one surface that drivingly engages a flat surface (not shown) formed in a portion of the bore to provide a radially compliant driving arrangement, such as shown in Assignee's U.S. Pat. No. 4,877,382, the disclosure of which is hereby incorporated herein by reference. Oldham coupling 68 is also provided positioned between orbiting scroll member 356 and upper bearing housing 26 and keyed to orbiting scroll member 356 and upper bearing housing 26 to prevent rotational movement of orbiting scroll member 356.

A non-orbiting scroll member 370 is also provided having a wrap 372 extending downwardly from an end plate 374 that is positioned in meshing engagement with wrap 358 of orbiting scroll member 356. Non-orbiting scroll member 370 has a centrally disposed discharge passage 376 that communicates with discharge fitting 18 which extends through end cap 14.

Non-orbiting scroll member 370 is fixedly secured to two-piece upper bearing housing 26 by plurality of bolts 80 which prohibit all movement of non-orbiting scroll member 370 with respect to upper bearing housing 26. Orbiting scroll member 356 is disposed between non-orbiting scroll member 370 and upper bearing housing 26. Orbiting scroll member 356 can move radially as described above in relation to the radially compliant drive for compressor 310. Orbiting scroll member 356 can also move axially by means of a floating thrust seal 382 disposed within annular recess 54.

Floating thrust seal 382 comprises a pair of annular valve bodies 384 with one annular body 384 sealingly engaging the interior wall of recess 54 at 386 and the other annular body 384 sealingly engaging the exterior wall of recess 54 at 388. Annular valve bodies 384 define an inner face seal 390 and an outer face seal 392 which are urged against end plate 360 of orbiting scroll member 356 by fluid pressure supplied to recess 54. The seal at 386 seals against the inner wall of recess 54, the seal at 388 seals against the outer wall of recess 54 and face seals 390 and 392 seal against end plate 360 of orbiting scroll member 356 to isolate recess 54 from suction pressure refrigerant within shell 12. The design parameters for floating thrust seal 382 are selected in such a way that, under internal pressurization, annular valve bodies 384 stay in constant contact with end plate 360 of orbiting scroll member 356 by means of face seals 390 and 392. The majority of the axial biasing load applied to orbiting scroll member 356 is supplied by the refrigerant gas pressure within recess 54 rather than by mechanical contact between face seals 390 and 392 and end plate 360 of orbiting scroll member 356. This reduces mechanical friction and wear of face seals 390 and 392 and the corresponding surface of end plate 360 of orbiting scroll member 356. While not illustrated in FIG. 10, pressurization of recess 54 is achieved using one or more passages 96 which extend from an area of end plate 360 open to recess 54 through end plate 360 to one or more of the compression chambers formed by wraps 358 and 372 as shown in FIGS. 1-4*c*. Also, scroll compressor 10 can include the optional oil injection system 212 illustrated above for compressor 210.

During orbiting motion of orbiting scroll member 356 with respect to non-orbiting scroll member 370, a plurality of passages 396 which extend through end plate 360 control the pressure within a recess 398. The end of each passage 396 extending through end plate 360 connects to one of a plurality of recesses 398 which are machined into end plate 374 of non-orbiting scroll member 370. The location, size and shape of passage 396 and recess 398 will determine the opening and closing of gas communication between the compressed gas in the suction area of scroll compressor 310 and recess 398 as well as the opening and closing of gas communication between recess 54 and recess 398. In addition, the transition time of the pressure equalization between the suction area of scroll compressor 310 and recess 398 and the transition time of the pressure equalization between recess 54 and recess 398 is controlled by the location, size and shape of passage 396 and recess 398. The timing of the opening and closing in conjunction with the transition time can be selected such that it will minimize excessive axial force applied to end plate 360 of orbiting scroll member 356 but at the same time the axial force will keep orbiting scroll member 356 in constant contact with non-orbiting scroll member 370.

Scroll compressors create a contingent axial force that tries to separate the two mating scrolls due to the compression process. This force changes in a revolution with ten to thirty percent of the fluctuation depending on the operating condition. To overcome the separating force and hold the mating scrolls together, a constant gas pressure is applied from the back side of the orbiting scroll member by using a sealing system which is typically provided on a stationary part of the scroll compressor. In order to keep the scroll members together at all times with the constant pressure acting against the fluctuating separating force, the backpressure that creates the holding force must be equal to or more than the peak value of the fluctuating force creating an excessive pressure. As a result, the excessive force will be exerted on the mating axial surfaces of the sealing system. This excessive force causes frictional losses that deteriorates the efficiency of the compressor.

Figure 11A:
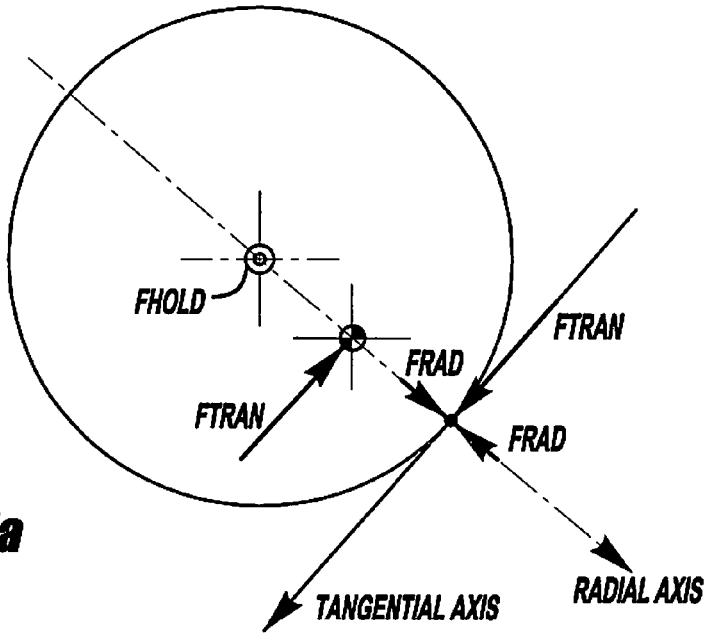
FIG. 11*a* is a plan view of a force diagram for the orbiting scroll member of the present invention.
Figure 11B:
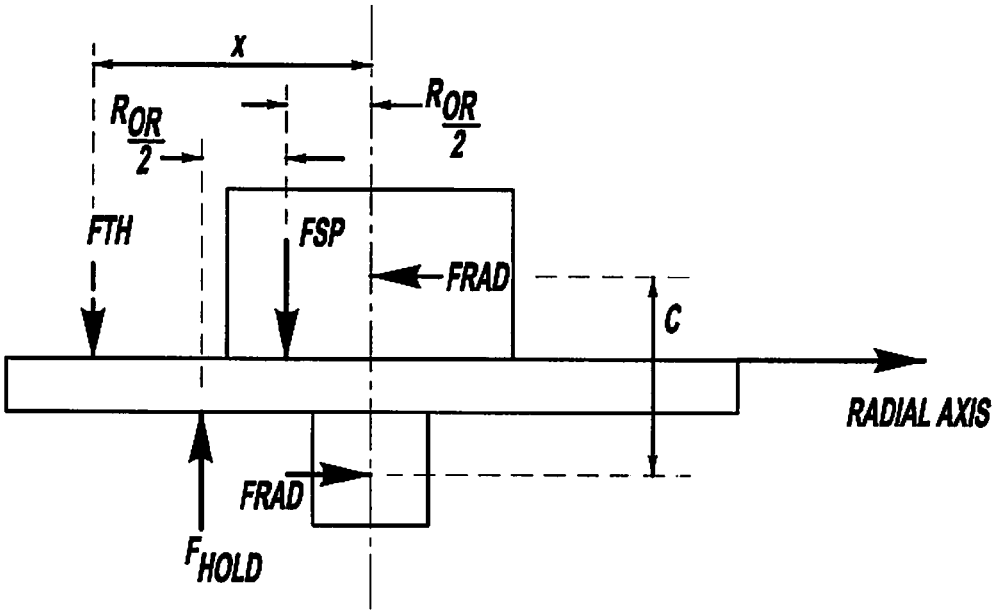
FIG. 11*b* is a side view force diagram for the orbiting scroll member taken along the radial axis.
Figure 11C:
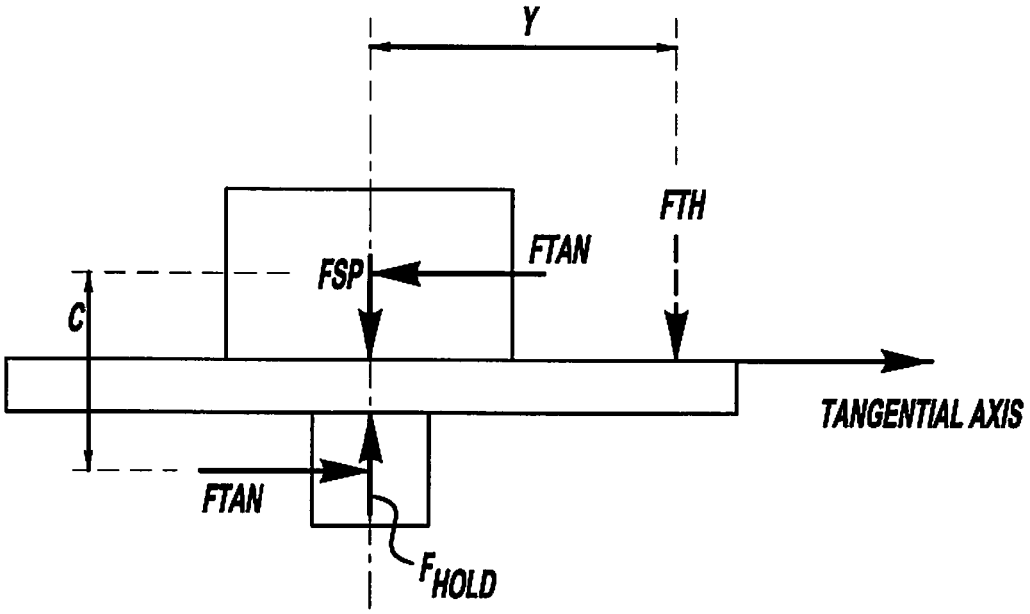
FIG. 11*c* is a side view force diagram for the orbiting scroll member taken along the tangential axis.

There is another circumstance which requires an unwanted excessive force. This is due to the presence of the "scroll particular" over-turning moment which is schematically illustrated in FIGS. 11*a*-11*c*. Since the separation force $F_{SP}$ and the holding force $F_{HOLD}$ are separately placed by a half of the orbiting radius $R_{OR}$, the centroid of the excessive force $F_{TH}$ needs to occur at the opposite side of the axis (shown in X) in order to balance out the moment from the two forces $F_{SP}$ and $F_{HOLD}$. As seen in FIG. 11*b*, the force balance in the axial direction can be represented by the following equation [1].

$$F_{HOLD}=F_{TH}+F_{SP} \quad [1]$$

The location X illustrated in FIG. 11*b* becomes off setting from the central axis with which the holding force $F_{HOLD}$ gets close to the separation force $F_{SP}$ to eliminate the excessive force and its location can be represented by the following equation [2].

$$X = \frac{\frac{R_{OR}}{2} \cdot F_{SP} - C \cdot F_{RAD}}{F_{TH}} + R_{OR} \quad [2]$$

Substituting equation [1] into equation [2] gives us the location for X which can be represented by the following equation [3].

$$X = \frac{\frac{R_{OR}}{2} \cdot F_{SP} - C \cdot F_{RAD}}{F_{HOLD} - F_{SP}} + R_{OR} \quad [3]$$

The location of $F_{TH}$ is also affected by the other moment balance in the tangential plane shown in the following equation [4].

$$Y \cdot F_{TH}=C \cdot F_{TAN} \quad [4]$$

This equation can be written as $$Y = \frac{C \cdot F_{TAN}}{F_{TH}} \quad [5]$$

and substituting equation [1] in this equation gives us the position for Y.

$$Y = \frac{C \cdot F_{TAN}}{F_{HOLD} - F_{SP}} \quad [6]$$

Figure 12:
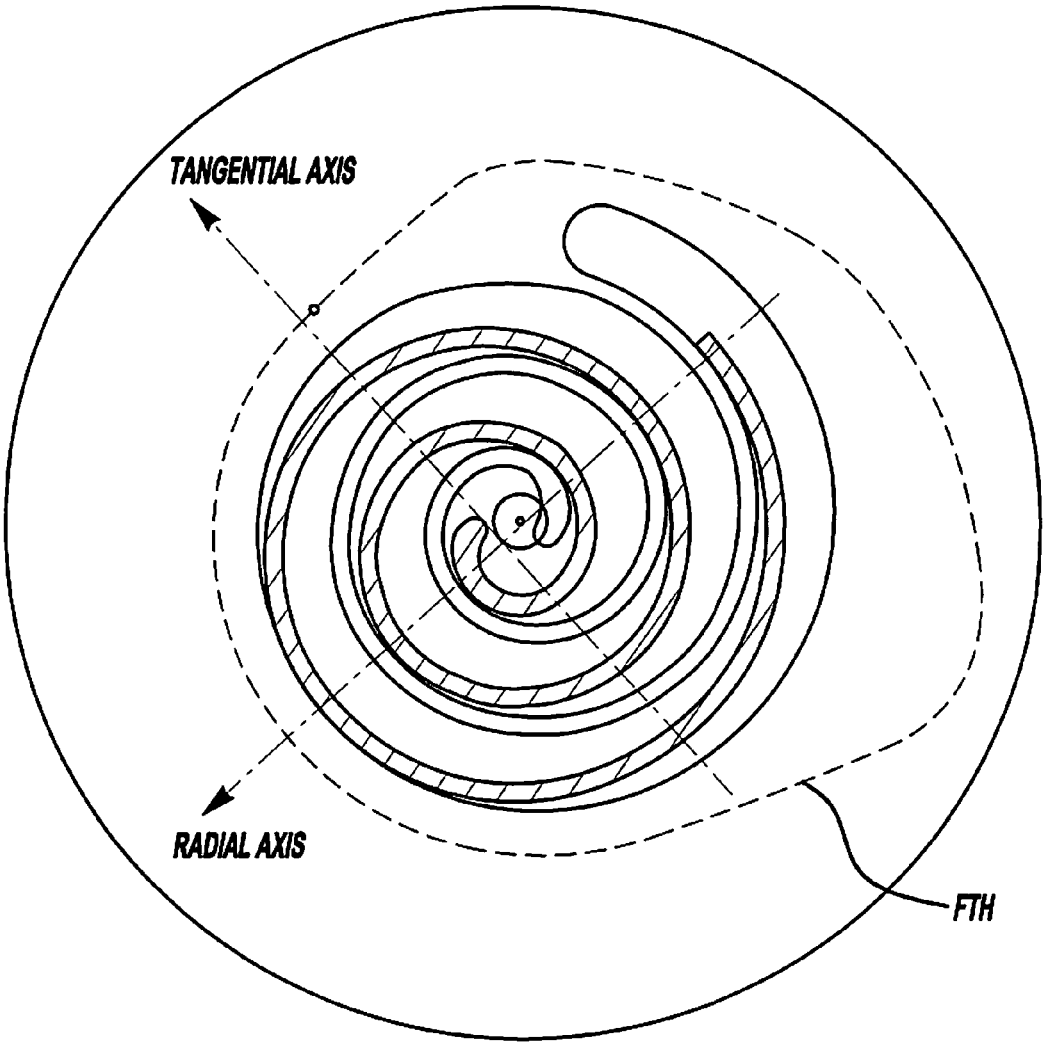
FIG. 12 is a plan view illustrating the trajectory of the forces on the orbiting scroll member illustrated in FIG. 10.
Figure 13:
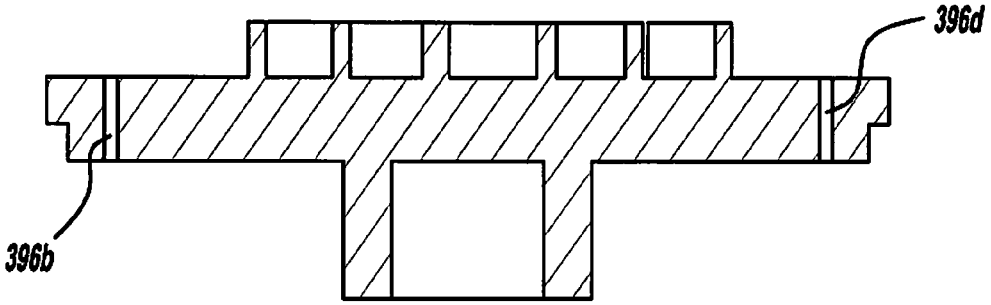
FIG. 13 is a side cross-sectional view of the orbiting scroll member illustrated in FIG. 10.
Figure 14:
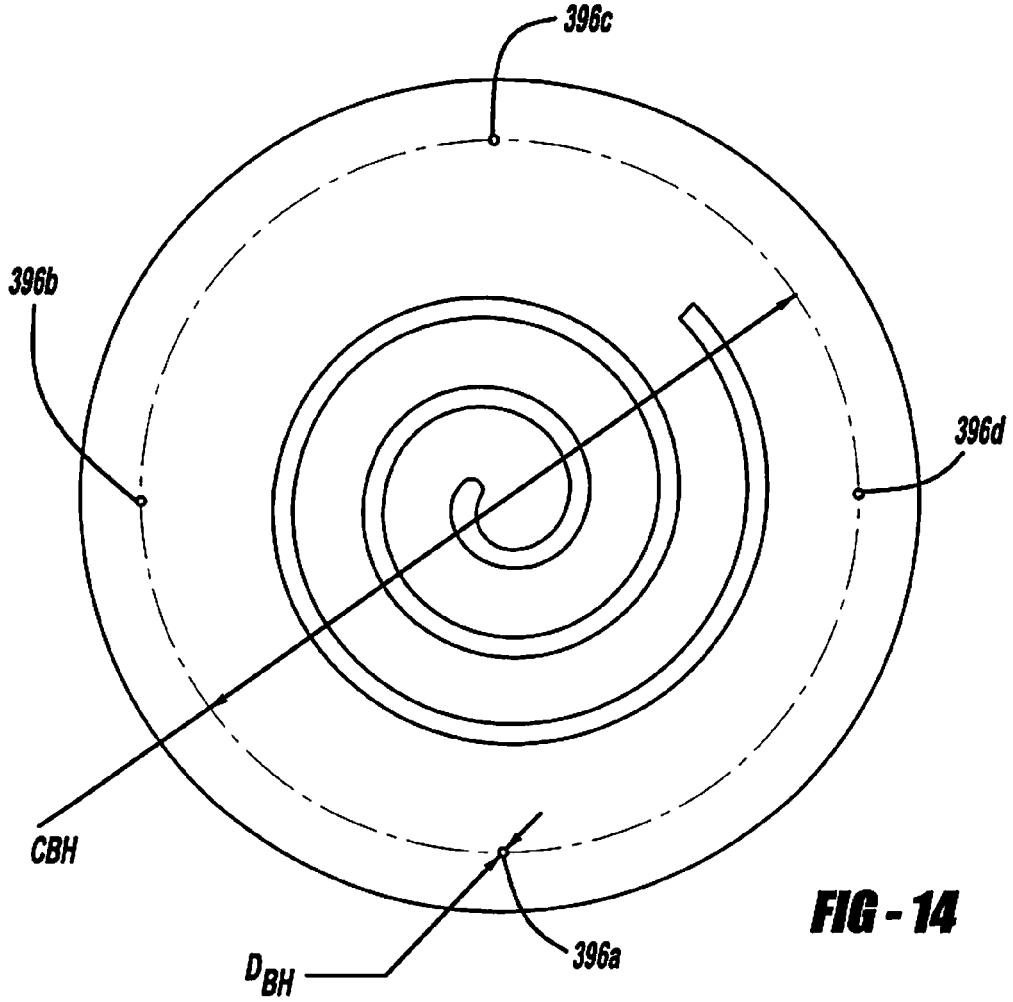
FIG. 14 is a plan view of the orbiting scroll member illustrated in FIG. 10.
Figure 15:
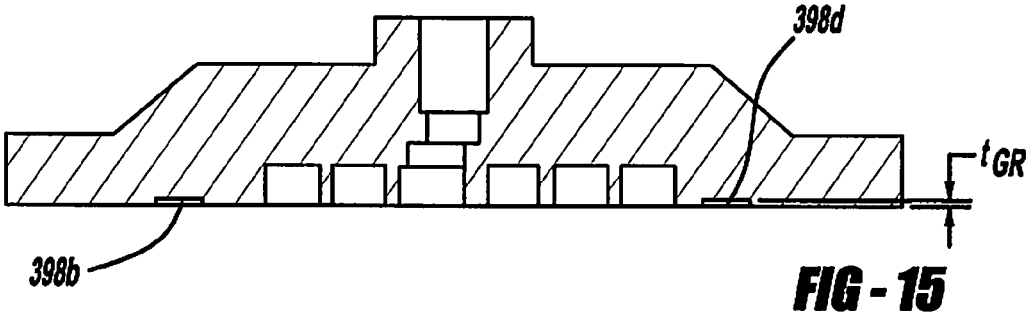
FIG. 15 is a side cross-sectional view of the non-orbiting scroll member illustrated in FIG. 10.

As indicated, the Y location also becomes off from the central axis by minimizing the excessive force ($F_{HOLD}$-$F_{SP}$). For most of scroll compressors, the $F_{TH}$ positions near the tangential line, which is extended from the center of the orbiting scroll toward the rotation direction of the orbit. As the tangential and radial axes rotate, $F_{TH}$ moves along the tangential axis resulting in drawing a closed loop trajectory as illustrated in FIG. 12 by the dashed line. If no axial surface is provided between the mating scroll members at the location of $F_{TH}$, the orbiting scroll member will tilt over and thus result in the scroll compressor being inoperative. Therefore, the excessive force is allowed to be reduced only within the range of which $F_{TH}$ does not go across the outer edge of the axial surface between the mating scrolls.

A typical approach to overcome such excessive force is to widen the axial thrust area in order to extend the outer edge of the axial surface as well as to reduce the contact force per unit area. With this approach, however, it brings about the compressor shell diameter being larger which is against the market demand for miniaturization. In addition, lubrication of this increased surface area presents additional problems.

The present invention addresses this issue by increasing and decreasing the fluid pressure within recess 398 which creates a pressure biasing chamber during the cycle of rotation in order to counteract the circumferential movement of $F_{TH}$. The increasing and decreasing of the fluid pressure within recess 398 is described above where recess 398 is cyclically placed in communicated with the suction area of compressor 310 and the fluid pressure within recess 54.

FIGS. 13-18 illustrate the positional and geometrical information about the plurality of passages 396 in end plate 360, the plurality of recesses 398 formed in end plate 374 and an axial sealing surface 400 of annular recess 54 provided at the backside of end plate 360.

Preferably, four passages 396*a-d* are arranged circumferentially around end plate 360 at a ninety degree interval at a diameter of $C_{BH}$ from the center of orbiting scroll member 356. The diameter $D_{BH}$ for each passage 396 is preferred, but not limited to be matched to a seal width of outer face seal 392. Preferably four recesses 398*a-d* are arranged circumferentially around end plate 374 at a diameter $C_{GR}$. The four recesses 398 are not interconnected with each other and thus they can each be treated as an independent volume. The depth of each recess $t_{GR}$ is preferred, but not limited to be considerably small such as less than a millimeter. Recesses 398 are arranged at ninety degree interval on diameter $C_{GR}$ from the center of non-orbiting scroll member 370. Recesses 398 are preferred but are not limited for each to have a width $L_{GR}$ which is equal to or greater than twice the orbiting radius $R_{OR}$. The diameter $C_{GR}$ is preferred to be the same size of diameter $C_{BH}$ of passage 396. Also, the diameter $C_{GR}$ is preferred, but not limited to be the same as the diameter $C_{SEAL}$ of outer face seal 392. The matching of diameters $C_{GR}$ and $C_{SEAL}$ permit the fabrication of the plurality of passages 396 by a simple vertical drilling operation.

An angular orientation of the four recesses 398 is preferred, but not limited to be arranged so that the symmetric axis of each recess coincides with the radial direction of a respective passage 396.

FIGS. 19*a*-19*d* show the positional relationship between the passages 396, the recesses 398 and the outer sealing surface of outer face seal 392 at each ninety degree rotation of orbiting scroll member 356 with respect to non-orbiting scroll member 370. The relative position of each passage 396 and the outer sealing surface of outer face seal 392 are successively changed as the center $O_{os}$ of orbiting scroll member 356 orbits on the orbiting circle $C_{OR}$ around the center $O_{FS}$ of non-orbiting scroll member 370. Each passage 396 comes across the axial sealing surface of outer face seal 392 twice during one revolution of orbiting scroll member 356. Thus, the bottoms of passages 396 are repeatedly and alternately exposed to high pressure (e.g., discharge pressure) and low pressure (e.g., suction pressure) refrigerant environments. The exposure of each passage 396 becomes phase-delayed by ninety degrees such that the exposures occur on respective passages 396 one after another during the orbital motion.

Figure 20:
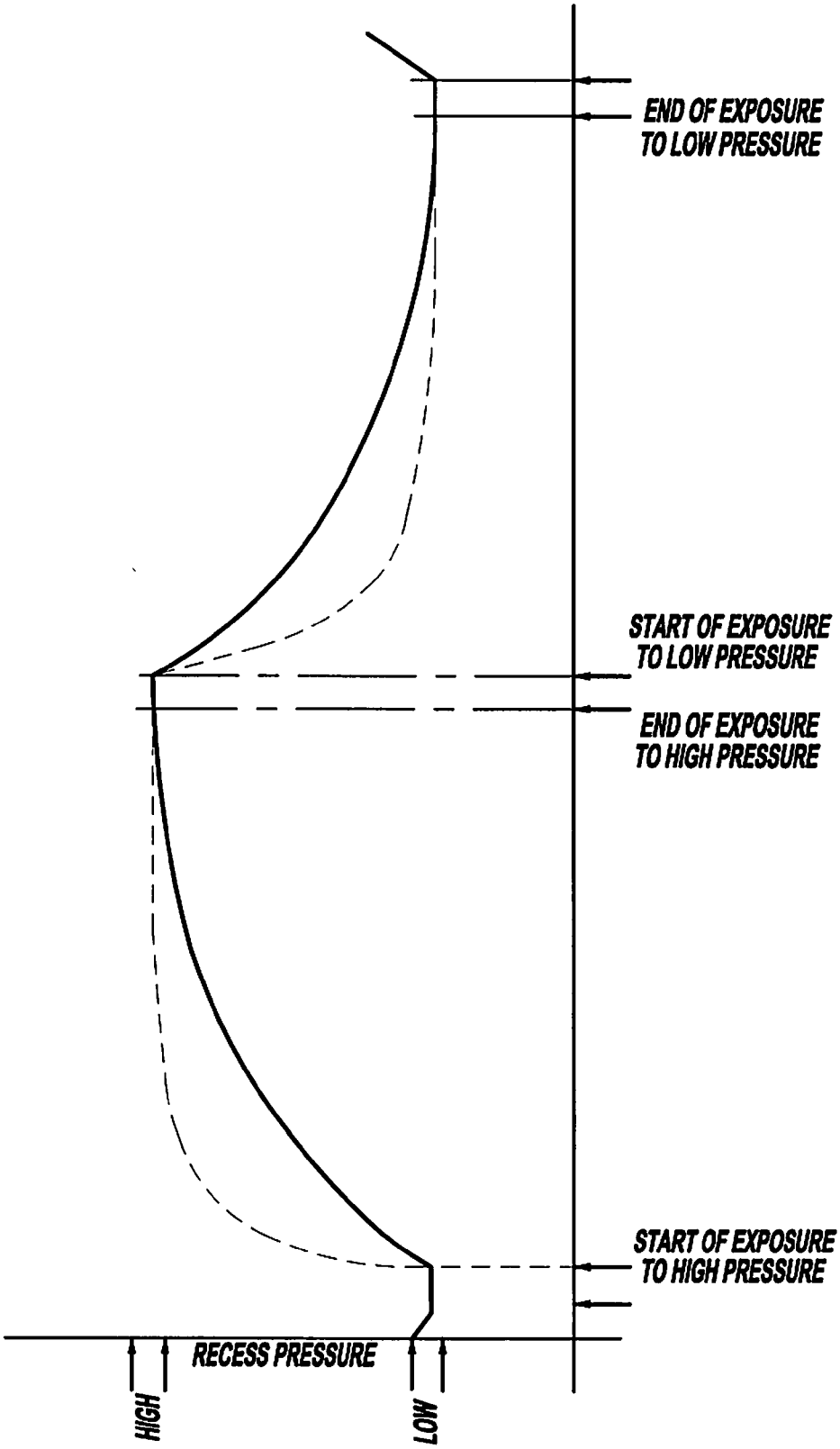
FIG. 20 illustrates the relationship between the pressure within the recesses during orbiting of the orbiting scroll member.

The upper end of each passage 396 is in communication with a respective recess 398 at all times. Therefore, the pressures of fluid within recesses 398 fluctuates during each revolution of orbiting scroll member 356 as the result of the alternate exposure of passages 396 to the high and low pressures of the refrigerant environment. A typical pattern of the pressure fluctuation in each recess 398 is shown in FIG. 20. The pressure increases when passage 396 is exposed to the high pressure environment and it decreases when it is exposed to the low pressure environment. Although the rate of the increase and the decrease of the pressure within each recess 398 is affected by the volume of the recess and the flow resistance of passage 396, the peak pressure always appears at the end of the exposure of passage 396 to the high pressure and the bottom pressure occurs at the end of the exposure of passage 396 to the low pressure. This is illustrated in FIG. 20 where the solid line indicates recess pressure for a large volume recess 398 or a high flow resistance passage 396 and the dashed line indicates recess pressure for a small volume recess 398 or a low flow resistance passage 396.

Figure 16:
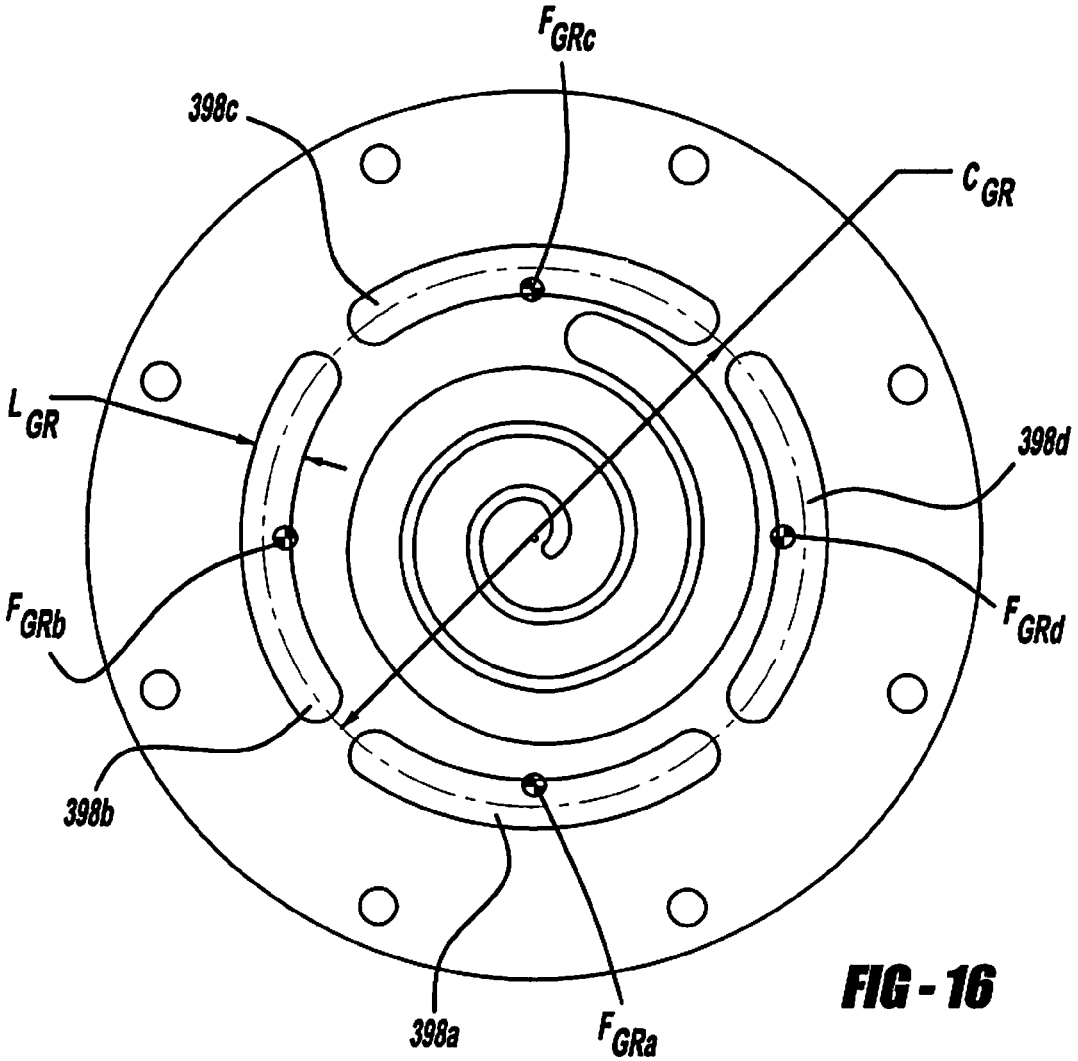
FIG. 16 is a plan view of the non-orbiting scroll member illustrated in FIG. 10.
Figure 17:
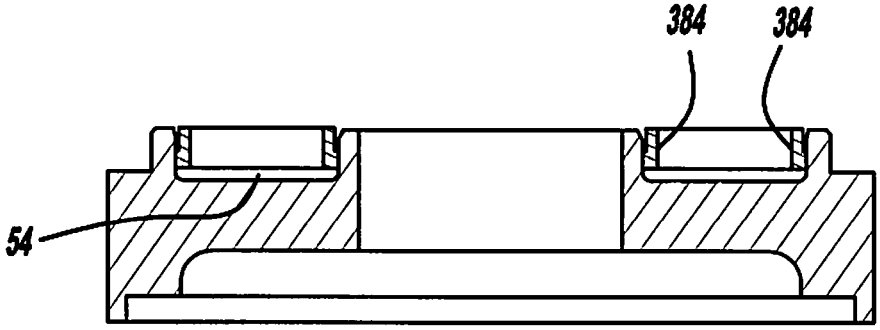
FIG. 17 is a side cross-sectional view of the main bearing housing illustrated in FIG. 10.
Figure 18:
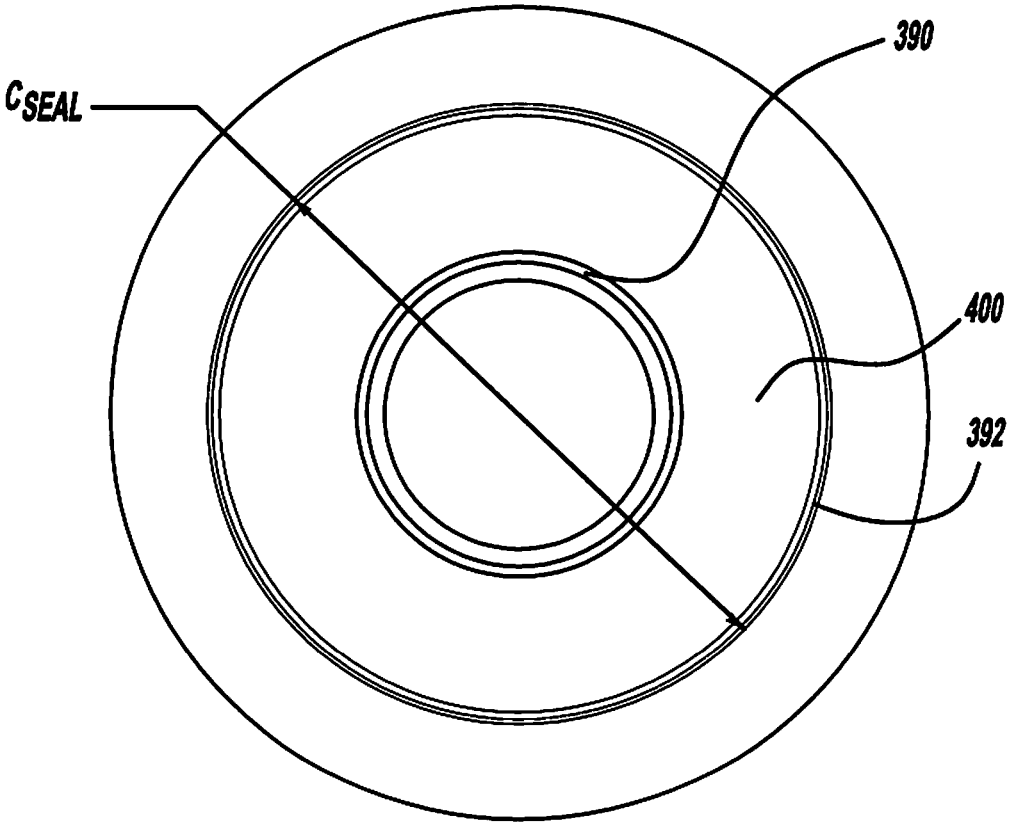
FIG. 18 is a plan view of the main bearing housing illustrated in FIG. 10.
Figure 19A:
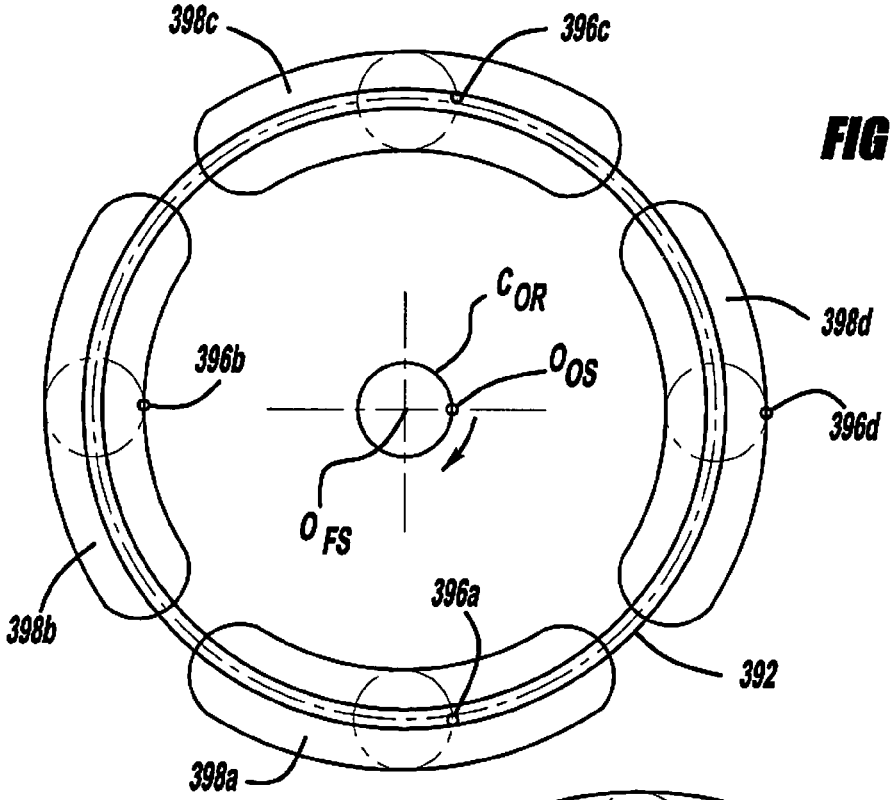
FIGS. 19*a*-19*d* illustrate the relationship between the passages, the recesses and the sealing lip for the scroll compressor illustrated in FIG. 10.
Figure 19B:
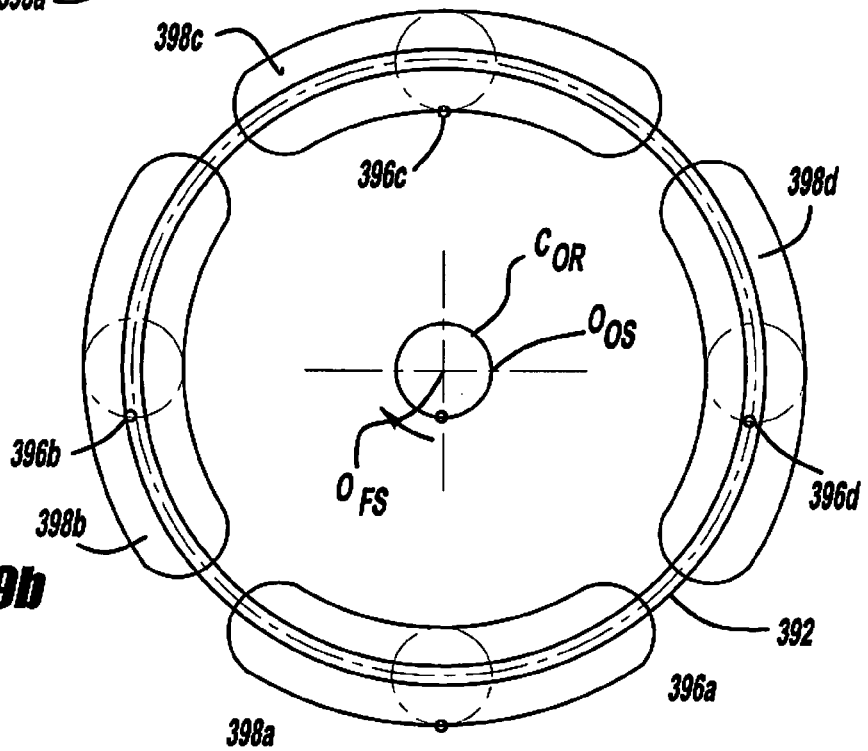

In the crank position illustrated in FIG. 19*a*, passage 396*a* is located at the ending position of the exposure to the inside of recess 54 which holds a higher pressure than the suction area of scroll compressor 310. Thus, at this crank position, the pressure within recess 398*a* reaches its maximum, generating a peak force to counteract the excessive force $F_{TH}$, which is generated by the overturning moment. Since the pressure within recess 398 is uniform, the location of the force should be represented by the centroid of the recesses axial area, which is shown in FIG. 16 as $F_{GRA}$.

As illustrated in FIG. 12, the excessive force $F_{TH}$ always appears near the tangential line, which is extended from the center of orbiting scroll member 356 toward the rotational direction of orbit. As seen in FIG. 16, the centroid of the counteracting force $F_{GRA}$ is located close to $F_{TH}$. Providing the counteracting force $F_{GRA}$ close the $F_{TH}$ will negate most of the excessive force $F_{TH}$ and prevent a residual moment due to the presence of a minimum distance between $F_{GRA}$ and $F_{TH}$.

Figure 19C:
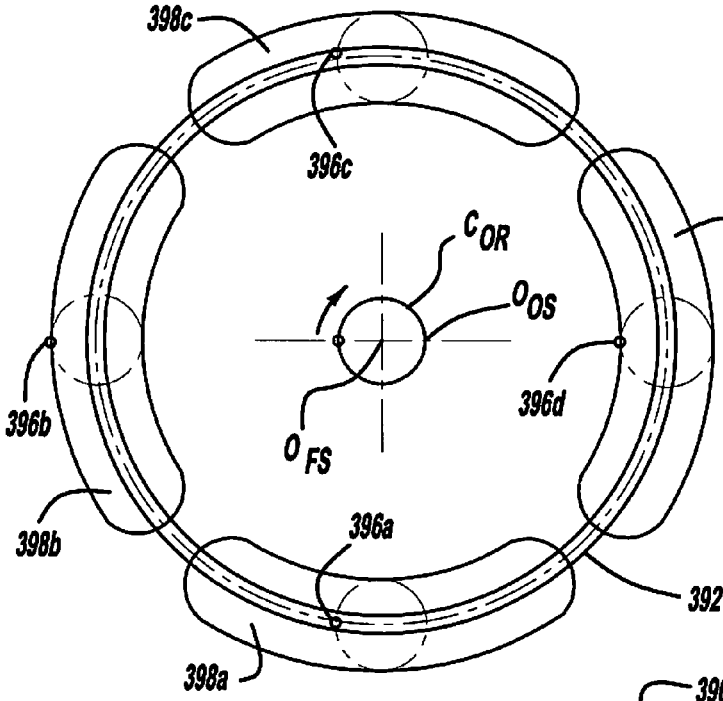
Figure 19D:
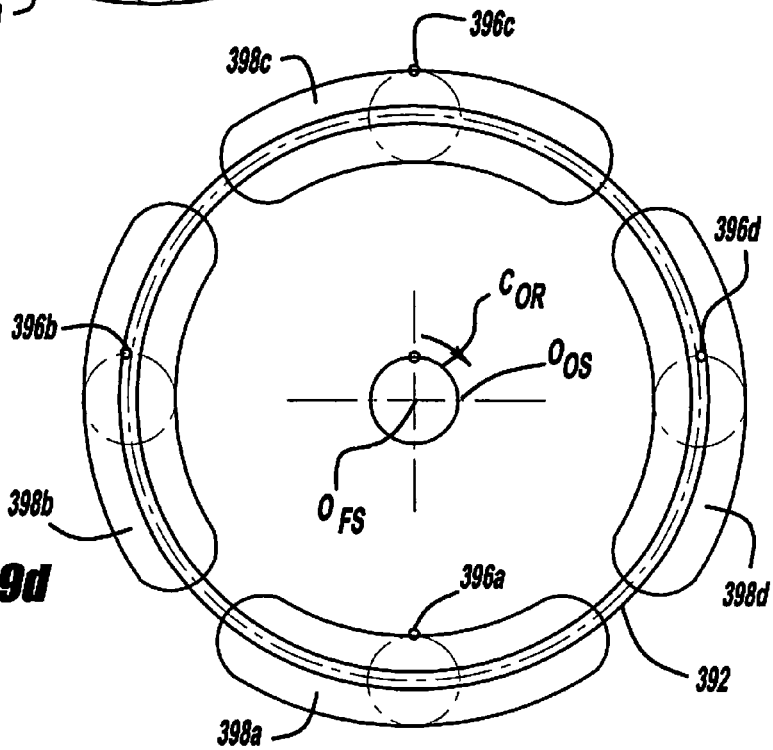

As the orbital motion proceed from the crank position illustrated in FIG. 19*a* to that illustrated in 19*b*, passage 396*a* comes across the outer sealing surface of outer face seal 392 and will be exposed to the suction area of scroll compressor 310. The pressure within recess 398*a* will start to decrease and thus reduce the counteracting from recess 398*a*. On the next recess 398*b*, however, the respective passage 396*b* is approaching the end position of the exposure to the inside of pressurized recess 54 which is increasing the pressure within recess 398*b*. In the middle position between FIGS. 19*a* and 19*b*, therefore, both recesses 398*a* and 398*b* hold an intermediate pressure which generates intermediate counteracting forces at both $F_{GRA}$ and $F_{GRB}$. These two forces can also be represented by the centroid of the two recesses which is located between the two centroids of the two recesses. The location of the counteracting force therefore moves circumferentially in the direction of the orbital motion and follows the movement of $F_{TH}$ which is illustrated in FIG. 12 by the dashed line. FIGS. 19*c* and 19*d* each illustrate an additional ninety degrees of orbital motion.

Figure 21:
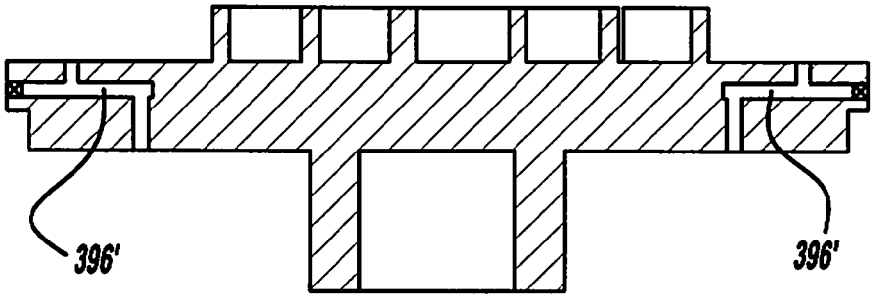
FIG. 21 illustrates a side cross-sectional view of an orbiting scroll member in accordance with another embodiment of the present invention.
Figure 22:
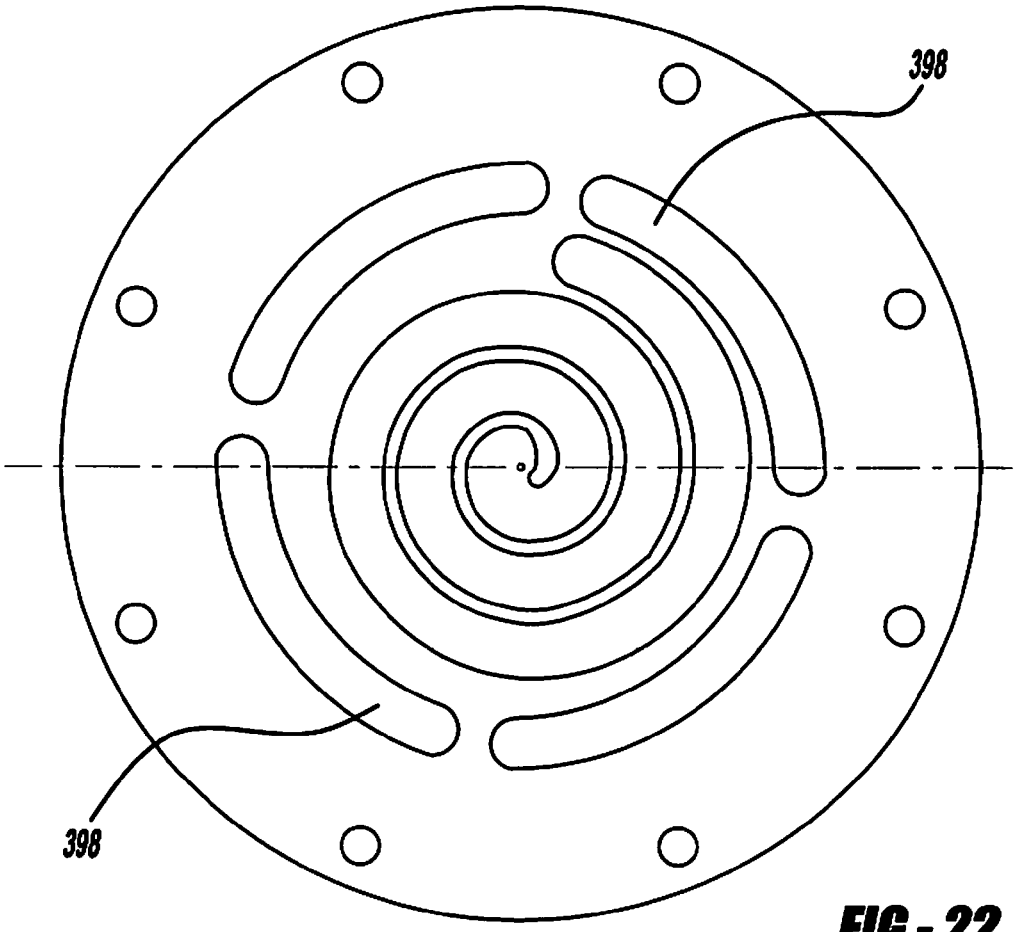
FIG. 22 illustrates a plan view showing an orientation of the recesses of the non-orbiting scroll member in accordance with another embodiment of the present disclosure.

The passages 396*a-d* are illustrated as vertical and straight on the premise of which diameter of the concentric circles of recesses $C_{GR}$ matches with the diameter of the sealing face of outer face seal 392. This premise sometimes cannot be met due to layout restrictions in relation to the other components. Passages 396 can be replaced with passage 396' illustrated in FIG. 21 so that the bottom of passages 396' are still exposed to the inside and outside of recess 54 repeatedly and alternately. As illustrated in FIG. 22, the angular orientation of recesses 398 can be modified within forty-five degrees from the case of the preferred embodiment with the symmetric axis of each groove coinciding with the radial direction of the respective passage 396. This will allow shifting of the centroid of the respective recesses 398 in the circumferential direction and further minimizing the distance between the excessive force $F_{TH}$ and the counteracting force $F_{GR}$. While FIG. 22 illustrated modification in a clockwise direction, it is within the scope of the present invention to modify recesses 398 in a counter-clockwise direction if desired.

Figure 23:
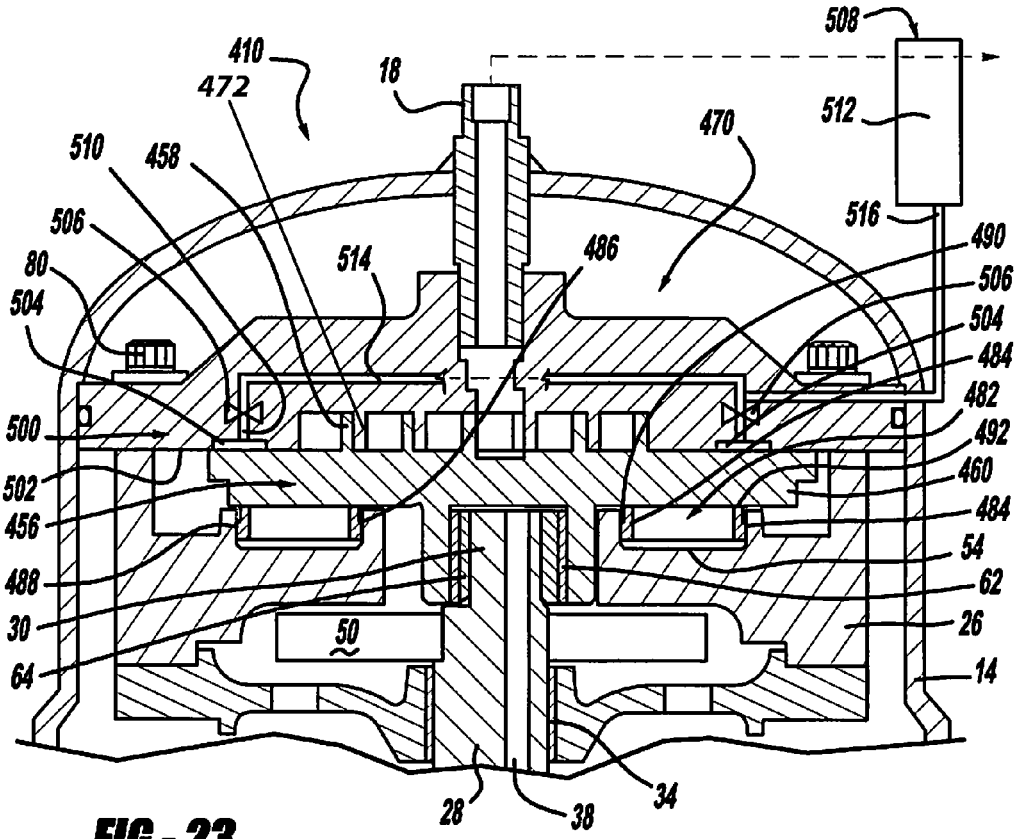
FIG. 23 illustrates a side view cross-section of a scroll compressor in accordance with another embodiment of the present disclosure.
Figure 24:
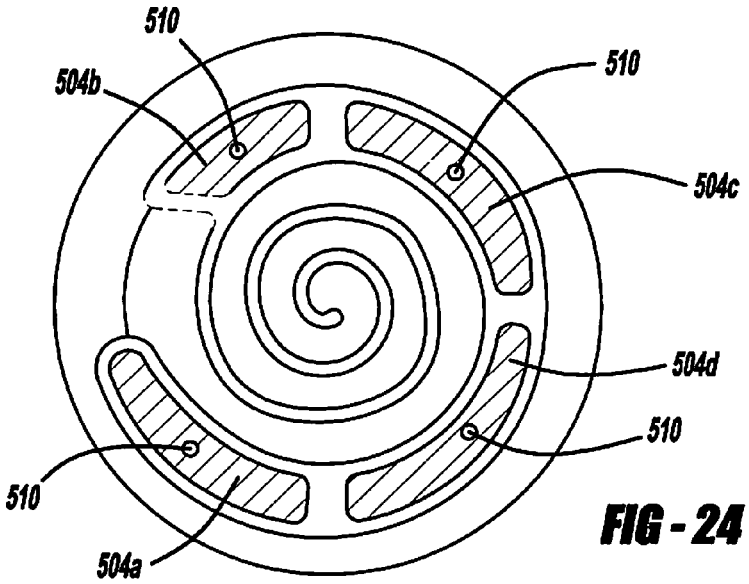
FIG. 24 is a plan view, partially in cross-section showing the oil pressure ports illustrated in FIG. 23.

Referring now to FIGS. 23 and 24, a scroll compressor 410 in accordance with the present invention is illustrated. Scroll compressor 410 is the same as scroll compressor 10 but scroll compressor 410 incorporates a hydrostatic thrust bearing. Compressor 410 comprises generally cylindrical hermetic shell 12 having welded at the upper end thereof cap 14 and at the lower end thereof plurality of mounting feet 16. Cap 14 is provided with refrigerant discharge fitting 18. Other major elements affixed to shell 12 include lower bearing housing 24 that is suitably secured to shell 12 and two piece upper bearing housing 26 suitably secured to lower bearing housing 24.

Drive shaft or crankshaft 28 having eccentric crank pin 30 at the upper end thereof is rotatably journaled in bearing 32 in lower bearing housing 24 and second bearing 34 in upper bearing housing 26. Crankshaft 28 has at the lower end the relatively large diameter concentric bore 36 that communicates with radially outwardly inclined smaller diameter bore 38 extending upwardly therefrom to the top of crankshaft 28. The lower portion of the interior shell 12 defines oil sump 40 that is filled with lubricating oil to a level slightly above the lower end of rotor 42, and bore 36 acts as a pump to pump lubricating fluid up crankshaft 28 and into bore 38 and ultimately to all of the various portions of the compressor that require lubrication.

Crankshaft 28 is rotatively driven by the electric motor including stator 46, winding 48 passing therethrough and rotor 42 press fitted on crankshaft 28 and having upper and lower counterweights 50 and 52, respectively.

The upper surface of upper bearing housing 26 is provided with annular recess 54 above which is disposed an orbiting scroll member 456 having the usual spiral vane or wrap 458 extending upward from an end plate 460. Projecting downwardly from the lower surface of end plate 460 of orbiting scroll member 456 is a cylindrical hub having a journaled bearing 462 therein and in which is rotatively disposed drive bushing 64 having an inner bore in which crank pin 30 is drivingly disposed. Crank pin 30 has a flat on one surface that drivingly engages a flat surface (not shown) formed in a portion of the bore to provide a radially compliant driving arrangement, such as shown in Assignee's U.S. Pat. No. 4,877,382, the disclosure of which is hereby incorporated herein by reference. Oldham coupling 68 is also provided positioned between orbiting scroll member 456 and upper bearing housing 26 and keyed to orbiting scroll member 456 and upper bearing housing 26 to prevent rotational movement of orbiting scroll member 456.

A non-orbiting scroll member 470 is also provided having a wrap 472 extending downwardly from an end plate 474 that is positioned in meshing engagement with wrap 458 of orbiting scroll member 456. Non-orbiting scroll member 470 has a centrally disposed discharge passage 476 that communicates with discharge fitting 18 which extends through end cap 14.

Non-orbiting scroll member 470 is fixedly secured to two-piece upper bearing housing 26 by the plurality of bolts 80 which prohibit all movement of non-orbiting scroll member 470 with respect to upper bearing housing 26. Orbiting scroll member 456 is disposed between non-orbiting scroll member 470 and upper bearing housing 26. Orbiting scroll member 456 can move radially as described above in relation to the radially compliant drive for compressor 410. Orbiting scroll member 456 can also move axially by means of a floating thrust seal 482 disposed within annular recess 54.

Floating thrust seal 482 comprises a pair of annular bodies 484 with one annular body 484 sealingly engaging the inner wall of recess 54 at 486 and the other annular body 484 sealingly engaging the exterior wall of recess 54 at 488. Annular valve bodies 484 define an inner face seal 490 and an outer face seal 492 which are urged against end plate 460 of orbiting scroll member 456 by fluid pressure supplied to recess 54. The seal at 486 seals against the inner wall of recess 54, the seal 488 seals against the outer wall of recess 54 and face seals 490 and 492 seal against end plate 460 of orbiting scroll member 456 to isolate recess 54 from suction pressure refrigerant within shell 12. The design parameters for floating thrust seal 482 are selected in such a way that, under internal pressurization, annular valve bodies 484 stay in constant contact with end plate 460 or orbiting scroll member 456 by means of face seals 490 and 492. The majority of the axial biasing load applied to orbiting scroll member 456 is supplied by the refrigerant gas pressure within recess 54 rather than by mechanical contact between face seals 490 and 492 and end plate 460 of orbiting scroll member 456. This reduces mechanical friction and wear of face seals 490 and 492 and the corresponding surface of end plate 460 of orbiting scroll member 456. Pressurization of recess 54 is achieved using the one or more passages 96 which extends from an area of end plate 460 open to recess 54 through end plate 460 and through scroll wrap 458 of orbiting scroll member 456.

Scroll compressor 410 incorporates a hydrostatic thrust bearing 500 or non-orbiting scroll member 470. Hydrostatic bearing 500 is located at a thrust surface 502 of non-orbiting scroll member 470 which mates with end plate 460 of orbiting scroll member 456. This positions hydrostatic bearing 500 exterior to non-orbiting scroll wrap 472. Hydrostatic bearing 500 comprises one or more recesses 504 disposed on thrust surface 502, one or more throttling devices 506 such as orifices, tubes, valves, capillaries or other throttling devices known in the art, a high pressure oil source 508 and one or more oil passages 510 that connect high pressure oil source 508 to one or more recesses 504. An oil-separator 512 can be used for high pressure oil source 508 and as illustrated in FIG. 23, oil-separator 512 is located at the discharge end of scroll compressor 410.

As described above, scroll compressor can create a contingent axial force by its compression mechanism which tries to separate the two mating scrolls. This force changes during a revolution of the orbiting scroll member with ten to thirty percent of the fluctuation depending on the operating condition. To overcome the separating force and hold the mating scroll members together, a constant back pressure is generally applied from a side of the non-orbiting scroll member or from a side of the orbiting scroll member. In order to keep the scroll members together with the constant back pressure against the fluctuating separating force, the back pressure that creates a force equal to or more than the peak value of the fluctuating force is chosen. As a result, the excessive clamping force at the time of other than when the peak force occurs will be applied to the scroll members resulting in mechanical loss. This loss becomes more significant if the scroll compressor creates a large axial force relative to the useful work output (tangential force) such as a scroll compressor for $CO_2$ refrigerant.

Preferably four separate recesses 504*a-d* are provided on thrust surface 502 of non-orbiting scroll member 470. Recesses 504*a-d* are located circumferentially to surround scroll wrap 472. By using separate recesses 504*a-d*, the capability to carry the eccentric bias-load which scroll members normally generate will be enhanced. Each recess has its own throttling device 506 to provide each recess 504 with its own independent oil carrying capacity. This feature is also necessary for the eccentric load. The land of each recess 504 is adjusted in height to be flush with the tip surface of non-orbiting scroll wrap 472.

A common oil passage 514 connects to each recess 504 through a high pressure oil line 516 connected to oil separator 516. As detailed above, a constant back pressure from recess 54 is applied to end plate 460 of orbiting scroll member 456.

Hydrostatic thrust bearing 500 will provide rigidity to the load carrying capacity against the clearance between the two mating surfaces, end plate 460 and thrust surface 502. Hydrostatic thrust bearing 500 will carry additional load as the clearance between the two surfaces decrease. When there is excessive force applied to orbiting scroll member 456 from the fluid pressure within recess 54, orbiting scroll member 456 comes closer to non-orbiting scroll member 470. Hydrostatic thrust bearing 500 will generate an increased reaction force as orbiting scroll member 456 comes closer to non-orbiting scroll member 470. Both the biasing force and the reaction force will balance out at a certain clearance where orbiting scroll member 456 will stop its axial movement. As a result, orbiting scroll member 456 stays in a floating state with respect to non-orbiting scroll member 470 not transferring forces between the tips of scroll wraps 458, 472 and end plates 474, 460, respectively. This floating state of orbiting scroll member 456 eliminates the friction loss between the scroll tips and the end plates.

This reduction becomes more of a significant factor when the biasing load created by the pressurized fluid in recess 54 is large. This is especially true for scroll compressors that create significant fluctuation of the separating force such as the ones for $CO_2$ refrigerant. Hydrostatic thrust bearing 500 accommodates this fluctuating force by allowing a change in the floating position of orbiting scroll member 456. If this change in the floating position becomes too large, the performance of the scroll compressor may be degraded due to leakage of the compressed gas between adjacent scroll pockets. If the change in the floating position becomes too large, the prevention of gas leakage can be accomplished by designing recesses 504 and throttling devices 506 to realize the maximum rigidity which will then bring about the minimum change in the floating position in relation to the fluctuation of the load.

Hydrostatic thrust bearing 500 can be intentionally designed to be, more or less, too small in its load carrying capacity against the separating force. Hydrostatic thrust bearing 500 will then carry a part of the separation force at the two mating scroll members in contact. Although, in this design, hydrostatic bearing 500 does not completely eliminate the tip friction, it still reduces the friction drastically by receiving axial stress at the tip of the scroll.

While the present invention is illustrated with hydrostatic thrust bearing being on the non-orbiting scroll member with an axially movable orbiting scroll member, hydrostatic bearing 500 can be incorporated into an orbiting scroll member that does not move axially but which is mated with an axially movable non-orbiting scroll member.

The description is merely exemplary in nature and, thus, variations are intended to be within the scope of the teachings. Such variations are not to be regarded as a departure from the spirit and scope of the disclosure.

What is claimed is:

1. A compressor comprising:

a non-orbiting scroll including a first recess;

an orbiting scroll intermeshed with said non-orbiting scroll to form a plurality of compression pockets therebetween, said orbiting scroll including first and second passages, said first passage communicating with one of said compression pockets, said second passage communicating with said first recess; and a bearing housing supporting said orbiting scroll and defining a second recess adjacent to said orbiting scroll, said second recess communicating with said first and second passages.

2. The compressor of claim 1, further comprising a shell assembly defining a suction-pressure zone, wherein said first recess is intermittently in communication with said suction-pressure zone via said second passage.

3. The compressor of claim 2, wherein said first recess is intermittently in communication with said second recess when said first recess is fluidly isolated from said suction-pressure zone.

4. The compressor of claim 1, wherein said first recess is disposed in an axial end of said non-orbiting scroll that faces said orbiting scroll.

5. The compressor of claim 4, wherein said first recess is disposed radially outward relative to a spiral wrap of said non-orbiting scroll.

6. The compressor of claim 1, wherein said second passage is disposed radially outward relative to a spiral wrap of said orbiting scroll.

7. The compressor of claim 1, further comprising a floating seal disposed within said second recess and sealing against said orbiting scroll and axially extending walls of said second recess.

8. The compressor of claim 1, further comprising a shell assembly defining a suction-pressure zone, wherein said second recess receives pressurized working fluid from said compression pocket to axially bias said orbiting scroll.

9. The compressor of claim 1, wherein said orbiting scroll is axially movable relative to said bearing housing and said non-orbiting scroll.

10. The compressor of claim 9, wherein said non-orbiting scroll is fixedly secured to said bearing housing.

11. The compressor of claim 1, wherein said non-orbiting scroll includes a plurality of first recesses, and wherein said orbiting scroll includes a plurality of second passages communicating with said second recess, wherein all of said plurality of first recesses are disposed radially outward relative to a spiral wrap of said non-orbiting scroll and are disposed in an axial end of said non-orbiting scroll that faces said orbiting scroll, each of said plurality of first recesses communicating with said second passages and intermittently communicating with a suction-pressure zone of the compressor.

12. A compressor comprising:

a non-orbiting scroll including a first recess;

an orbiting scroll intermeshed with said non-orbiting scroll and including an end plate having a passage extending therethrough, said passage communicating with said first recess, said first recess intermittently communicating with a suction-pressure zone of the compressor via said passage; and a bearing housing supporting said orbiting scroll and defining a second recess containing pressurized working fluid biasing said orbiting scroll toward said non-orbiting scroll, said second recess intermittently communicating with said passage.

13. The compressor of claim 12, further comprising another passage in said orbiting scroll communicating with said second recess and a compression pocket defined by spiral wraps of said orbiting and non-orbiting scrolls.

14. The compressor of claim 12, wherein said first recess is intermittently in communication with said second recess when said first recess is fluidly isolated from said suction-pressure zone.

15. The compressor of claim 12, wherein said first recess is disposed in an axial end of said non-orbiting scroll that faces said orbiting scroll.

16. The compressor of claim 15, wherein said first recess is disposed radially outward relative to a spiral wrap of said non-orbiting scroll.

17. The compressor of claim 12, wherein said passage is disposed radially outward relative to a spiral wrap of said orbiting scroll.

18. The compressor of claim 12, further comprising a floating seal disposed within said second recess and sealing against said orbiting scroll and axially extending walls of said second recess.

19. The compressor of claim 12, wherein said non-orbiting scroll is fixedly secured to said bearing housing.

20. The compressor of claim 12, wherein said non-orbiting scroll includes a plurality of first recesses, and wherein said orbiting scroll includes a plurality of passages communicating with said second recess, wherein all of said plurality of first recesses are disposed radially outward relative to a spiral wrap of said non-orbiting scroll and are disposed in an axial end of said non-orbiting scroll that faces said orbiting scroll, each of said plurality of first recesses communicating with said passages and intermittently communicating with said suction-pressure zone of the compressor.

* * * * *